United States Patent [19]

Plumb

[11] Patent Number: 4,694,982

[45] Date of Patent: Sep. 22, 1987

[54] SIDE BY SIDE AIR FEEDER FOR ADVANCING STOCK TO A POWER PRESS AND THE LIKE

[75] Inventor: Edwin W. Plumb, Woodbury, Conn.

[73] Assignee: Pressmate, Inc., Woodbury, Conn.

[21] Appl. No.: 660,143

[22] Filed: Oct. 12, 1984

Related U.S. Application Data

[63] Continuation-in-part of Ser. No. 371,968, Apr. 26, 1982.

[51] Int. Cl.[4] ..... B65H 20/18

[52] U.S. Cl. ..... 226/115; 226/142; 226/150; 226/159; 226/162

[58] Field of Search ..... 226/159, 142, 122, 162, 226/149, 150, 158, 141, 134, 136, 137, 138, 115, 108; 74/99 R, 102, 107, 109, 36, 110, 29

[56] References Cited

U.S. PATENT DOCUMENTS

| | | | |
|---|---|---|---|
| 595,732 | 12/1897 | Pitt | 74/29 |
| 727,189 | 5/1903 | Nysewander | 74/109 |
| 2,948,417 | 8/1960 | Haanes | 74/109 X |
| 3,048,199 | 8/1962 | Barnes | 226/162 X |
| 3,200,686 | 8/1965 | Norton et al. | 226/162 X |
| 3,321,981 | 5/1967 | Ash, II | 74/110 X |
| 3,338,140 | 8/1967 | Sheesley | 74/109 X |
| 3,473,716 | 10/1969 | Butler | 226/142 |
| 3,863,823 | 2/1975 | Allred | 226/142 |
| 4,051,987 | 10/1977 | Scribner | 226/162 X |
| 4,160,518 | 7/1979 | Sribner | 226/162 X |
| 4,316,569 | 2/1982 | Gentile | 226/158 X |

FOREIGN PATENT DOCUMENTS

| | | | |
|---|---|---|---|
| 917242 | 8/1954 | Fed. Rep. of Germany | 226/158 |

*Primary Examiner*—Harvey C. Hornsby
*Assistant Examiner*—Scott J. Haugland
*Attorney, Agent, or Firm*—Hayes & Reinsmith

[57] ABSTRACT

A pneumatic feeder is disclosed having twin feed slides axially reciprocable in side by side relation along parallel axes for intermittently advancing strip stock to a downstream machine for further processing. Each feed slide has clamps which serve to advance the stock with the traveling slide clamps activated and the clamps of the other slide being deactivated during its idle return movement. Each feed slide additionally has a rotatable crank mechanism and a single acting power cylinder associated therewith for providing a primary motive force in a stock advancing direction in cooperation with the associated crank mechanism. The crank mechanism serves both to trigger actuation of the driving force of the power cylinder to advance its feed slide and additionally provide harmonic deceleration of its feed slide under high rates of feed to ensure precision termination of the advancing feed slide to positively limit its feed stroke. The construction of the disclosed feeder virtually eliminates undesired fluctuations in the advanced stroke limit positions of the stock during each feed cycle due to inherent lost motion of the associated drive mechanism.

42 Claims, 19 Drawing Figures

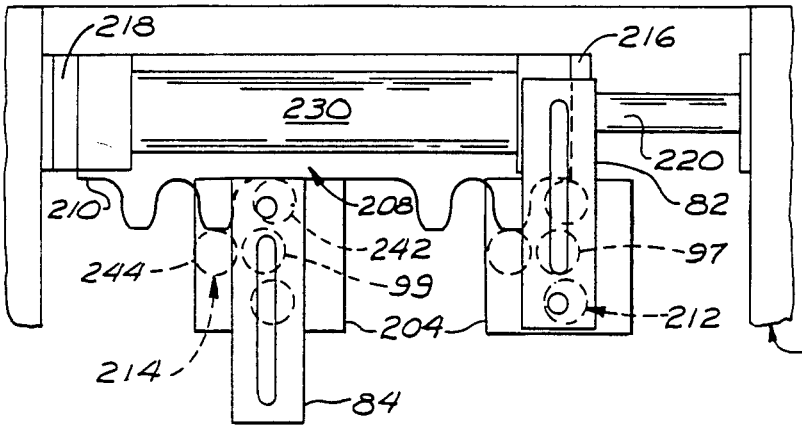
FIG. 10
FIG. 11
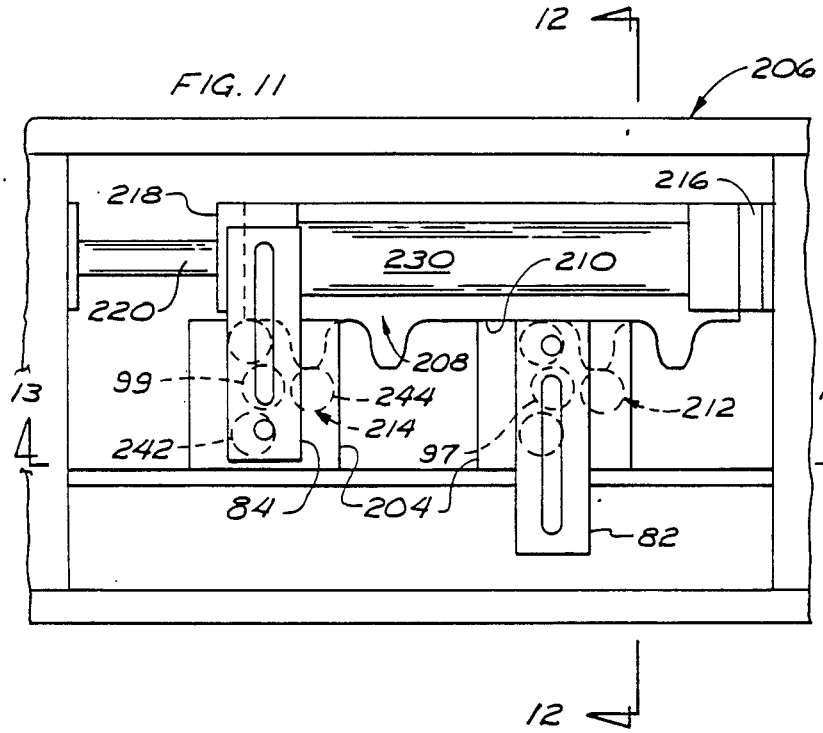
FIG. 12
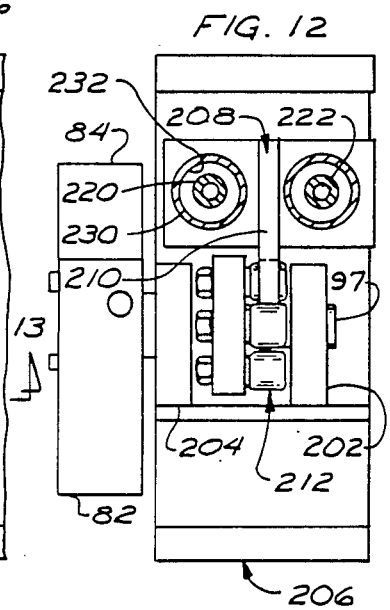
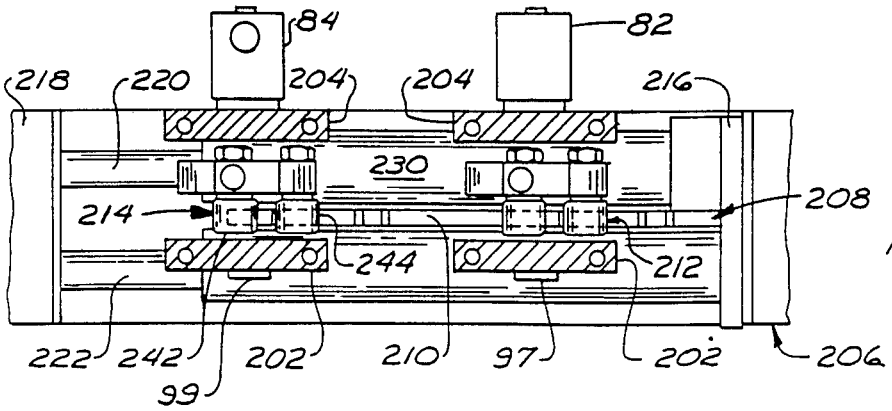
FIG. 13

SIDE BY SIDE AIR FEEDER FOR ADVANCING STOCK TO A POWER PRESS AND THE LIKE

This application is a continuation-in-part of my earlier filed co-pending application Ser. No. 371,968, filed Apr. 26, 1982.

FIELD OF THE INVENTION

This invention generally relates to feeders for advancing strip stock in a linear direction to a machine such as a power press and the like and specifically concerns high-speed pneumatic feeders of the type described.

BACKGROUND OF THE INVENTION

Known pneumatic feeders, as distinguished from mechanical feeders, are inexpensive and relatively easy to install in a production operation as they have no mechanical drive connection to a downstream machine such as a power press and the like and are accurate since the cycle of the actuating feed device is conventionally limited by positive mechanical stops at each end of the feed stroke.

However, a significant limitation of such known pneumatic feeders is the cycle rate at which they are capable of operating. In general, they must complete two strokes, the idle return stroke and the forward feed stroke, in limited allowed time periods.

Recent contributions to the art feature two conventional feed devices, one behind the other in tandem relation. One feed device returns as the other feed device feeds the stock to the downstream machine. This action considerably increases the cycle rate but also results in a rather elongated structure and has presented undesirable buckling problems when used with thin stock material.

A high speed dual-slide type pneumatic feeder is also disclosed in U.S. Pat. No. 4,051,987 issued in the name of Robert W. Scribner which is also an improvement in the pneumatic feeder art in intermittently advancing strip stock into a downstream work station whereby alternately acting feed slides are operable for strip stock advancing movements with one of the feed slides being activated to perform a stock advancing function during a simultaneous idle return stroke of the other feed slide.

However, a basic and heretofore unsolved problem inherent in the use of any known pneumatic feeder is the seemingly incompatible resolution of achieving precision stock positioning at the termination of an advancing feed stroke of the material at extraordinarily high feed rates and at the same time terminating that feed stroke to zero velocity in a non-destructive fashion. In addition, it is desired to both ensure termination of movement of the feed stroke and the feeder components while simultaneously ensuring against slippage of the stock material in a forwardly advancing direction upon arresting the feed component movement.

Simply stated, there are significant problems presented in attempting to achieve high production rates and yet bringing the mass of the feed mechanisms and stock material to zero velocity suddenly in production runs frequently requiring a magnitude of 300 strokes or more per minute with each stroke providing about a 4 inch advance. Previous attempts have been made to utilize trapped exhaust air in power drive cylinders to serve as buffers. This approach has been found to create undesired lengthening of the feeder cycling time. Insufficient buffering to increase the feed rate has proven to be ultimately destructive on positive mechanical stops, which are commonly utilized in the conventional art, and undesirably causes an excessive noise level and eventual loss of accuracy in the stock feed.

SUMMARY OF THE INVENTION

This invention has overcome the above noted disadvantages of the known prior art in serving to impart motion to twin side by side feed slides featuring a mechanical crank mechanism associated with each feed slide which cooperates with a linear single acting power cylinder in a stock advancing direction to drive the feed slide and stock clamped thereby into an advanced stroke limit position during each feed stroke. The associated crank mechanism serves both to effect harmonic deceleration of the feed slide, and the stock clamped thereby, to bring the same to a sudden non-destructive zero velocity halt in a precisely predetermined position readily established by simplified crank mechanism adjustment. Any requirement or even indeed desirability to utilize positive mechanical stops acting directly on the reciprocable feed slides is virtually eliminated by this invention which additionally is particularly suited for use with a relatively inexpensive pneumatic control circuit for quick and easy installation with minimized down time and service requirements, even under demanding conditions, while optimizing the cycle time.

To simultaneously move the crank mechanisms in a selected angular direction for synchronized feed slide action, the invention includes a drive which is connected to the crank mechanisms. Different embodiments of the drive are incorporated in this invention to effect simultaneous rotation of the feed slides in a common angular direction through a 180° angular displacement for moving the crank mechanisms in unison into first and second crank throw limit positions, respectively, while precisely locating the first and second feed slides in their respective starting and advanced stroke limit positions.

Other objects will be in part obvious and in part pointed out in more detail hereinafter.

A better understanding of the objects, advantages, features, properties and relations of the invention will be obtained from the following detailed description and accompanying drawings which set forth an illustrative embodiment and are indicative of the way in which the principle of the invention is employed.

BRIEF DESCRIPTION OF THE DRAWINGS

FIG. 10 is a plan view, partly broken away, of the feeder drive of FIG. 9 showing its crank mechanisms in a first in-line position;

FIG. 11 is a plan view, partly broken away, similar to that of FIG. 10 showing the crank mechanisms in an opposite in-line position;

FIG. 12 is a cross-sectional view taken generally along line 12—12 of FIG. 11;

FIG. 13 is a cross-sectional view, partly broken away, taken generally along line 13—13 of FIG. 11;

DESCRIPTION OF PREFERRED EMBODIMENTS

Figure 1:
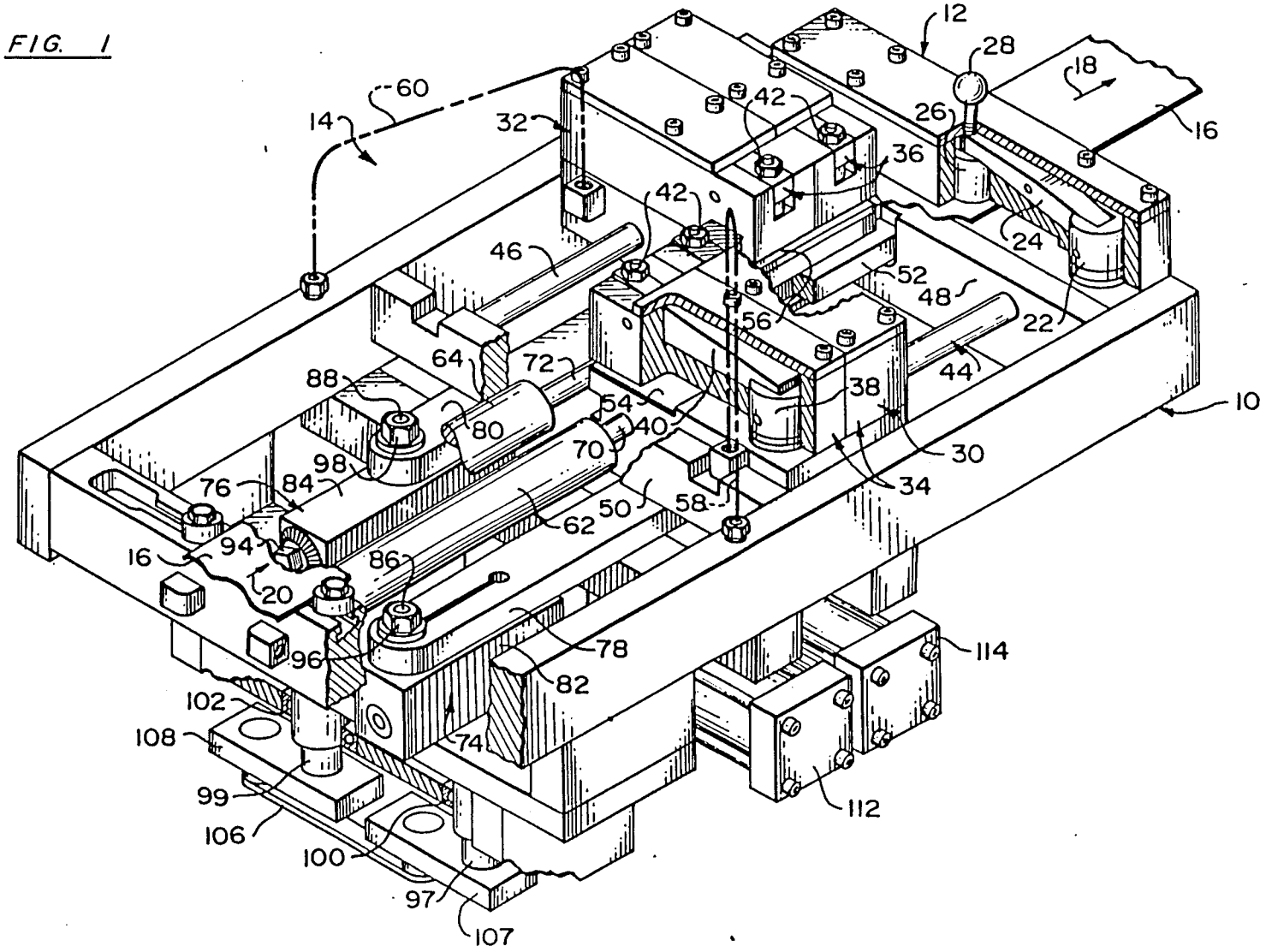
FIG. 1 is a perspective view, partly broken away and partly in section, illustrating a feeder incorporating this invention.

Referring to the drawings in detail, a generally rectangular unitary frame 10 supports a stationary clamp 12 at its downstream end which will be understood to be upstream of a machine such as a power press (not shown) and the like to which feeder 14 of this invention intermittently advances strip material such as metal stock 16 shown in FIG. 1 being driven in the direction of arrows 18, 20 through feeder 14 along its main longitudinal axis.

It will be understood that feeder 14 has twin left and right hand side components in mirror image relation to one another which are of substantially identical construction. For clarity of illustration, FIG. 1 depicts certain assembled components and others with parts in section and parts broken away. Stationary stock clamp 12, for example, is provided with a pair of air cylinders, a right hand cylinder shown at 22, each of which are drivingly connected to an actuating lever such as at 24 for driving a clamping plunger 26 downwardly upon admitting air under either piston, (not shown) of the air cylinders such as 22 which act through the levers such as 24. For loading stock material, plunger 26 may be raised manually through connected handle 28.

For advancing stock 16 through feeder 14 and into an associated downstream machine, a pair of alternately acting feed slides 30 and 32 are each provided with a pair of clamps 34, 34 and 36, 36 which are movable between stock clamping and release positions by single acting air-powered cylinders (such as the one right hand side clamp cylinder shown at 38) which will be understood to be drivingly connected by levers such as at 40 connected to a clamp plunger, not shown, to alternately clamp and release the stock 16 being advanced through feeder 14. As illustrated, each feed slide 30, 32 respectively carries a multiple, specifically two, clamps for insuring a positive clamping force on stock 16 and preventing any undesired stock travel beyond a predetermined advanced stroke limit position, even under exceptionally high feed rates. Adjusting fasteners 42 serve to accurately position the clamp plungers, not shown, which are acted upon by the operating levers such as at 40 relative to stock of varying thickness. Each clamp cylinder 38 and each stationary clamp cylinder 22 will be understood to be provided with a spring return, not shown, to restore the clamp to a released condition.

For supporting and guiding feed slides 30, 32 for reciprocating movement in parallel side by side relation on frame 10 in alignment with its main longitudinal axis, slides 30, 32 are slidably mounted on individual guide rods 44, 46 (secured between a downstream ene member 48 of frame 10 and a parallel intermediate cross member 50) and are also supported on a common guide bar 52 of square cross-section secured between frame members 48, 50. Each of the slides 30, 32 is supported on bar 52 below lower stock support surfaces 54 and 56 (FIG. 1) of slide clamps 34 and 36. Air line connections are schematically illustrated at 58 and 60 for supplying and exhausting air under the pistons of their respective air cylinders of slide clamps 34 and 36.

For advancing slides 30, 32, a primary motive force is provided by a pair of drive cylinders 62, 64 which are single acting in a linear stock advancing direction and having pistons, not shown, and piston rods 70, 72, respectively, drivingly connected to slides 30, 32. Drive cylinders 62, 64 are suitably mounted in fixed relation to frame 10.

For controlling operation of slides 30, 32 a pair of rotary crank mechanisms (generally designated 74, 76) are mounted on frame 10 for rotational movement about an axis perpendicular to the reciprocating movement of slides 30, 32 and are respectively drivingly connected thereto. The crank mechanisms 74, 76 are movable through a predetermined displacement in opposite angular directions precisely defining first and second crank throw limit positions for terminating movement of their respective slides 30, 32 in opposite linear directions between starting and advanced stroke limit positions.

More specifically, each feed slide 30, 32 has a connecting link 78, 80 pivotally mounted by a vertical pivot pin, not shown, to a lower surface of its respective slide 30, 32 such that links 78, 80 are each horizontally movable about a vertical axis defined by its pivot pin connection to its respective slide 30, 32. The throw of each crank mechanism 74, 76 for each slide 30, 32 is determined by a rotatable crank head 82, 84 pivotally connected by a crank pin 86, 88 extending vertically between its respective link 78, 80 and crank head 82, 84 for the associated slide 30, 32.

Figure 2:
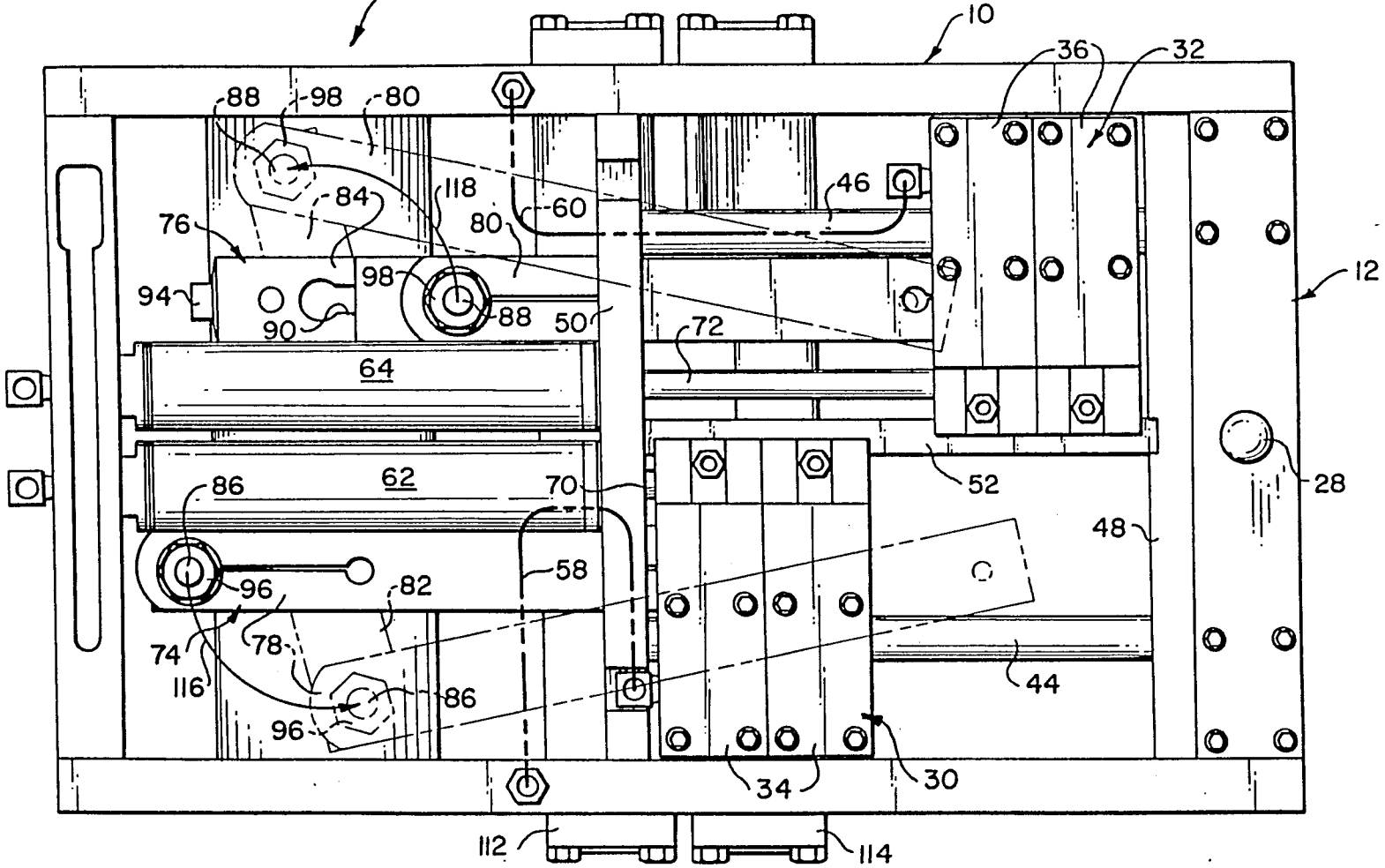
FIG. 2 is a plan view of the feeder of FIG. 1.
Figure 3:
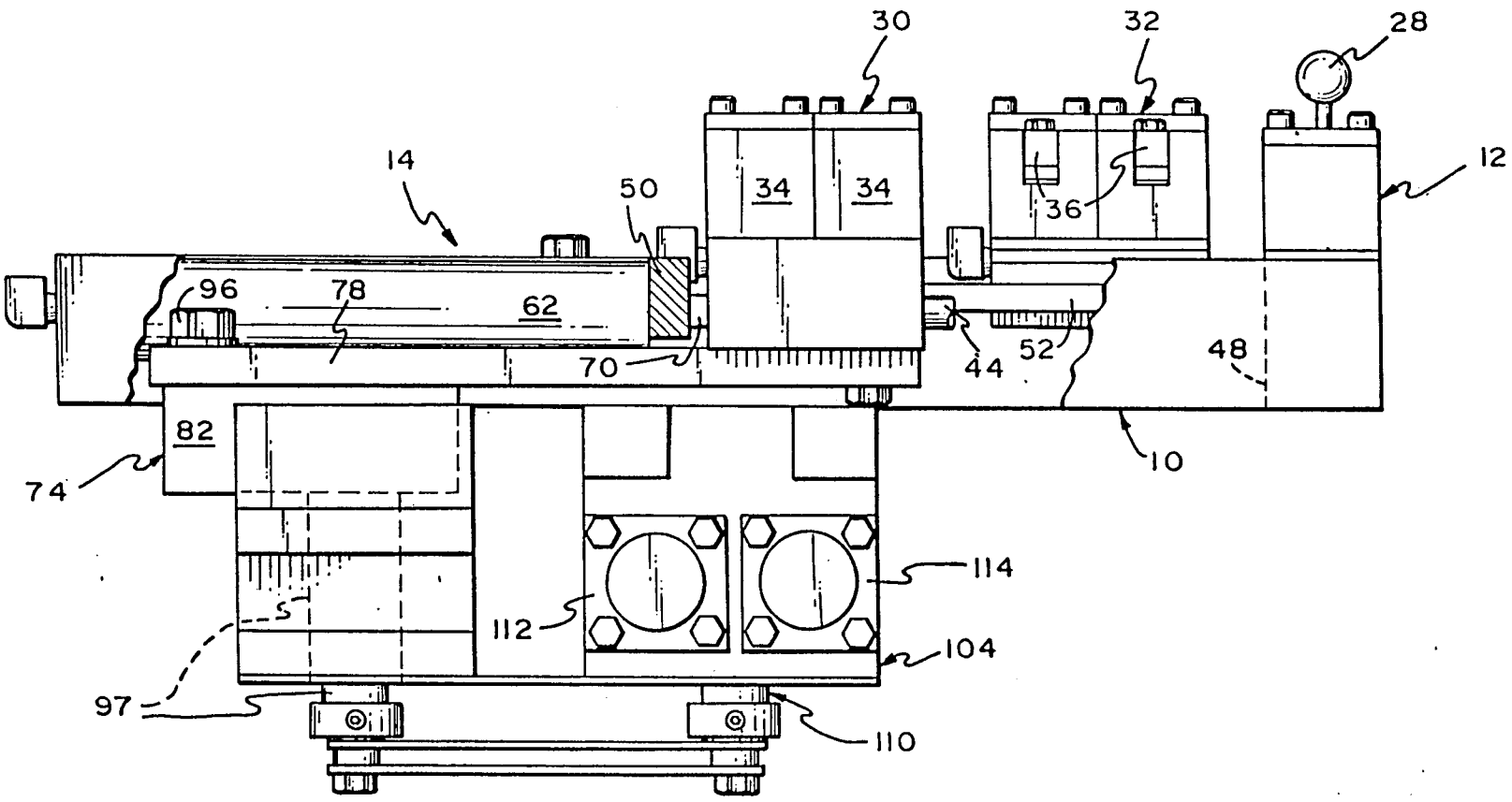
FIG. 3 is a side view, partly broken away and partly in section, of the feeder of FIG. 1.
Figure 4:
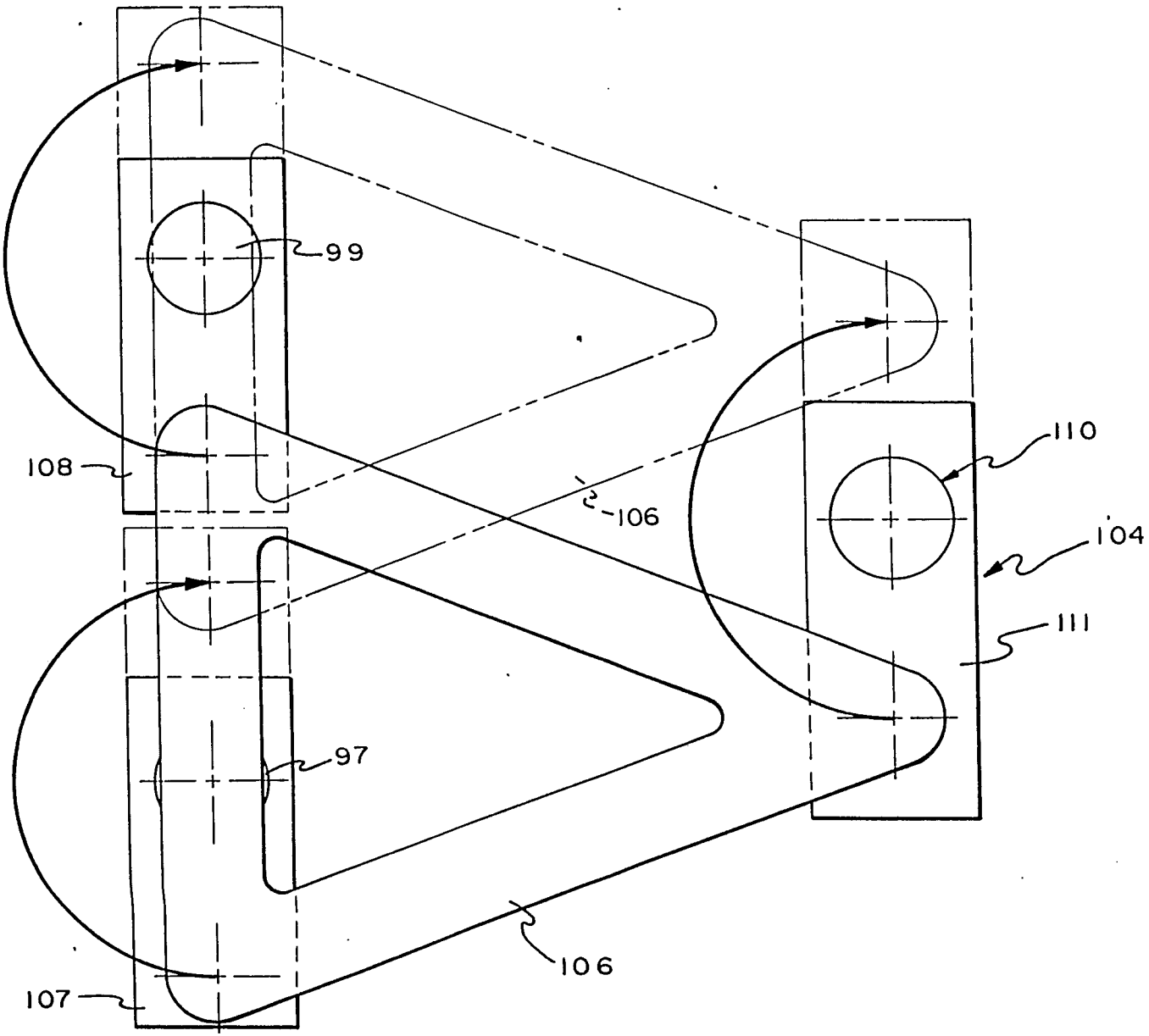
FIG. 4 is a plan view of a three point link which is a component of a rotary power actuator for the feeder of FIG. 1.

Relative positioning of each crank pin 86, 88 between its respective link 78, 80 and crank head 82, 84 is adjustable within a slot such as at 90 (FIG. 2) in crank head 84 by means of a lead screw, not shown, terminating in a hex head (such as at 94 of the left hand crank head 84 shown in FIGS. 1 and 2). The lead screw adjustment and, accordingly, the crank mechanism throw, is secured by suitable fasteners such as nuts illustrated at 96 and 98 (FIG. 1). These adjustable crank mechanisms 74, 76 control the slide feed stroke length and each are set to identical eccentricity relative to the axes of their respective rotatable operating shafts 97, 99 supported in bearings 100, 102 mounted in frame 10 and drivingly connected to a suitable rotary actuator 104 (FIGS. 3 and 4) supported on frame 10 for rotation in opposite angular directions and connected by suitable drive means to simultaneously rotate crank mechanisms 74, 76 in a common selected angular direction.

The adjustable crank heads 82, 84 which control the length of the feed strokes of their respective slides 30, 32 are precisely set to identical eccentricity relative to their operating shafts 97, 99. Crank heads 82, 84 are shown as being interconnected to one another and to their rotary actuator 104 such that on signal they will rotate 180° simultaneously in the same angular direction. Rotary actuator 104 is controlled by means, more specifically described below as a suitable fluid circuit means, for driving rotary actuator 104 successively in opposite angular directions for simultaneously operating slides 30, 32 in alternately power advance and idle return feed slide movements.

As illustrated in FIG. 1, right hand crank head 82 extends eccentrically directly to the rear of the axis of its operating shaft 97. The left hand crank head 84 is shown with its center located directly forwardly of the axis of its operating shaft 99. Consequently, rotation of the common rotary actuator 104 to drive a three link connector, e.g., as shown at 106 (FIG. 4) will effect 180° angular displacement of each operating shaft 97, 99 and its respective crank block 107, 108 in common angular directions to reverse the direction of the respective eccentricity of each crank head 82, 84 relative to its operating shafts 97, 99.

In summary, in the specifically illustrated embodiment, the pair of drive cylinders 62, 64 are suitably interconnected, as illustrated, to the two slides 30, 32 which are also drivingly connected via the crank mechanisms 74, 76 to operating shafts 97, 99 for crank heads 82, 84. A main rotary drive shaft 110 of actuator 104 is interconnected to the operating shafts 97, 99 by a crank arm 111 and the three point link connector 106, which minimizes rotary inertia and any resulting fly wheel effect due to extraordinary high feed rates of stock 16 which might otherwise be damaging to quick rotational reversals of the operating mechanisms for actuating the slides 30, 32.

Due to the above disclosed construction of the basic rotary drive actuating mechanism, its actuation by single acting air cylinders 112, 114 may be limited to 180° rotary movements in opposite angular directions by suitable conventional means to in turn limit the throw of each crank mechanism 74, 76 to a 180° displacement in either rotational direction.

In practice, crank heads 82, 84 respectively rotate between opposite in-line positions where, e.g., right hand crank head 82 (FIGS. 1 and 2) is driven from an in-line position with its crank pin 86 disposed rearwardly of its operating shaft 97 and precisely aligned with the axis of movement of its feed slide 30 and link 78 (FIGS. 1 and 2), to a 180° reversed position in a counterclockwise direction (illustrated by arrow 116 in FIG. 2). Crank head 82 accordingly then has been rotated by its operating shaft 97 again into precise alignment with the axis of movement of its slide 30, now in an advanced stroke limit position. Right hand link 78 is then again aligned with the longitudinal reciprocable axis of its slide 30.

Simultaneously with counterclockwise movement of right hand crank mechanism 74 of slide 30 from its starting to advanced stroke limit positions, rotary drive actuator 104 (which is connected to both crank mechanisms 74, 76 of slides 30, 32) drives left hand crank mechanism 76 in the same counterclockwise direction from its illustrated full line advanced stroke limit position shown in FIGS. 1 and 2 to a rear starting stroke limit position in the direction of arrow 118 (FIG. 2) with its slide 32 now in position corresponding to the position illustrated in FIGS. 1 and 2 formerly occupied by the right hand slide 30. Thus, rotary drive actuator 104 connected to the respective crank mechanisms 74, 76 simultaneously moves these mechanisms and their slides 30, 32 between their respective starting and advanced limit positions in a synchronized alternating action. A forward advancing movement of stock 16 is effected by its being gripped by the clamps of the one forwardly traveling slide during an idle return movement of the other slide from its advanced stroke limit position into a rear starting position with its associated clamps and the stationary clamp 12 in released condition.

Prior to a stock advancing forward movement of either slide 30, 32, its clamps are held in gripping relation to stock 16 to be advanced, its drive cylinder is conditioned to provide the primary motive power for a stock advancing feed stroke and is accordingly pressurized to effect that movement but the rotary drive actuator 104 is maintained, in accordance with this invention, in an activated condition to prevent any slide movement advancing stock 16 by restraining the associated slide crank mechanism from moving the rearwardly disposed slide forwardly. That rearwardly disposed slide and its crank mechanism (such as crank head 82 and its associated link 78 in FIG. 1) is maintained in a dead center aligned relation to the axis of reciprocation of its slide 30 and is held there by rotary drive actuator 104 prior to receiving a signal from the downstream machine indicative of its next upstroke of its operating mechanism whereupon stock advance is desired for the next machine operating cycle.

Accordingly, although drive cylinder 62 associated with the right hand slide 30, for example, of the feeder 14 is pressurized with fluid such as air "on" to that drive cylinder 62 and to clamps 34, 34 of the slide 30, and the feeder 14 is otherwise in readiness for the next stock advancing movement, the actuator 104 maintains the right hand crank head 82 in dead center alignment and biased in a clockwise direction (as viewed in FIGS. 1 and 2) against counterclockwise rotation of crank mechanism 74 under the influence of drive cylinder 62 until a suitable signal is received from the machine in response to an upstroke, e.g., of its next operating cycle.

As the machine starts that upstroke movement, a cam, not shown, drivingly connected to a crankshaft of the machine, for example, may be provided to operate a valve (described more specifically below), to provide a signal to the rotary drive actuator 104 to reverse its direction and drive the right hand crank mechanism 74 (of the right hand feed slide 30) off dead center and trigger a following movement of the previously pressurized drive cylinder 62 to move slide 30 forwardly from its illustrated starting position to an advanced stroke limit position by drive cylnder 62 in cooperation with the counterclockwise throw of its associated crank mechanism 74.

In accordance with the disclosed construction of feeder 14 of this invention, the slide crank mechanisms 74, 76 upon reaching a point slightly beyond mid-stroke, that is, somewhat beyond 90° angular displacement as shown in broken lines in FIG. 2 from starting positions, translates the respective angular velocity of each crank mechanism 74, 76 into a decreasing linear velocity of its associated feed slide due to the driving connection between each slide 30, 32 and its crank mechanism 74, 76 as the latter approaches a reversed dead center alignment with the axis of reciprocable movement of its slide.

This action accordingly effects harmonic deceleration of each slide 30, 32, and the travel of the crank mechanisms 74, 76 is arrested in response to the arrested movement of rotary drive actuator 104. This may be assisted, if desired, by urethane stops, not shown, for arresting the actuator travel and, when necessary, by trapped air buffering of its drive cylinders 112, 114.

It will now be seen that each crank head 82, 84 and associated link 78, 80 arrive at an in-line position in dead center alignment with the axis of reciprocating movement of its associated slide 30, 32 to in turn arrest slide travel and thereby effect a positive stop without undesirable direct impact of the moving slides on an immovable stop fixed to frame 10 as frequently encountered in conventional prior art devices. Accordingly, in the described construction, the stops, if so provided for the actuator 104, need not even be precisely accurate, for any slight angular displacement of crank heads 82, 84 from a dead center aligned position with the axis of slide movement has little, if any, effect on the advanced linear terminal stroke limit position of the slides 30, 32 near dead center position.

As previously described, the drive cylinders 62, 64 are single acting for each of the feed slides 30, 32 in a stock advancing direction only. During movement of the right hand slide 30 as described above to an advanced stroke limit position, crank mechanism 76 associated with the left hand feed slide 32 is rotating as shown in broken lines in FIG. 2 in a corresponding counterclockwise direction depicted by arrow 118 from its full line advanced stroke limit position to a reversed starting position to effect idle return of the left hand slide 32 under a clamp release condition during a stock advancing movement by right hand slide 30 with its clamps 34 activated. This idle movement of the left hand slide 32 in a return direction is entirely effected by the throw of the crank mechanism 76 and effects a corresponding return of the piston within drive cylinder 64 to starting position, exhausting the air from cylinder 64.

At the end of each feed stroke, a signal is generated as fully described below to cause certain sequential events in timed relation to downstream machine cycling. In one embodiment of this invention, one of the cylinders 112, 114 of the rotary actuator 104 which is connected to a suitable fluid circuit leaks an air signal upon completion of each feed stroke to activate stationary clamp 12 and deactivate the clamps of the slide which has just completed its travel into advanced feed stroke limit position.

As a result of the disclosed double clamp arrangement 34, 36 of each slide 30, 32, the mass of the traveling stock may be rapidly decelerated to zero velocity, and that material has been found to be positively secured in feeder 14 without undesired slippage (as has been encountered in certain known feeders) at the end of a feed stroke. Thereafter stationary clamp 12 is activated and the traveling clamps (of the recently arrested slide in advanced position) are released.

In progressive dies which consist of multiple stations, pilots are conventionally used in each station and serve to locate the material accurately. To ensure that work done in an upstream station properly registers with further processing to be done in a downstream station, certain holes may be pierced in the upstream station and pilots or pins with bullet noses may be fitted at the downstream station to enter such holes and thereby assure accurate progression and successive location of the stock material being fed through the power press. Accordingly, that stock should be stationary but free to move as the pilots enter the pierced material and, upon full entry of the pilots, the feed should then again grip that stock in preparation for the next cycle of the feeder 14.

In accordance with yet another aspect of this invention, the stationary clamping force on the stock 16 is relatively weak when compared to the clamping forces effected by the slide clamps, and the air pressure to the cylinders such as 22 of the stationary clamping device is adjustable to effect a preselected stationary clamping force to prevent any inadvertant movement of stock 16 but at the same time to allow such pilots (not shown) in a downstream die, e.g., of the downstream machine or power press to enter the stock material and permit the pilots to adjust its location precisely for a subsequent power press operation.

This action occurs at dead bottom center of a press stroke of the downstream machine wherein another cam connected to the machine crank shaft, not shown, may be utilized to operate an associated valve of the feeder fluid circuit to supply a signal for the next feeding cycle of stock feeder 14.

In response to such a signal, air to the right hand cylinder 62 is exhausted and air is supplied to the left hand cylinder 64 to pressurize that cylinder for a forward stock advancing movement. Air is also turned on to slide clamps 36, 36 of the left hand slide 32, and the air to stationary clamp 12 at the downstream end of frame 10 is exhausted. Under these conditions, the operation of the feeder components is precisely reversed as described above whereby what applied to the right hand slide 30 now applies to the left hand slide 32. Upon receiving the next feed signal, left hand slide 32 advances, right hand slide 30 returns in idle condition which is accomplished entirely by its associated crank mechanism 74 with its drive cylinder 62 deactivated.

As described, cylinders 62, 64 provide the primary or main driving stock advancing force to their respective slides 30, 32 and are designed to be sufficiently powerful to overcome any resistance to stock movement. The respective crank heads 82, 84 and associated links 78, 80 act both as trigger mechanisms and as precise accurately adjustable stop mechanisms to control the feed length and advance stroke limit positions of the associated slides 30, 32. Each cylinder 62 and 64, in urging its slide 30 and 32 forwardly as far as the crank mechanism 74 and 76 will allow, provides a unique precision stop mechanism quite separately and apart from any conventional stops frequently utilized in prior practice. The crank mechanisms 74 and 76 associated with each slide 30 and 32 maintain control of stock 16 in defining the maximum advanced limit position on each feed stroke in accordance with the throw or maximum forward displacement in an angular direction of the crank mechanism before any control of stock 16 is transferred. As each drive cylinder 62 and 64 urges its respective slide 30 and 34 forwardly as far as its associated crank mechanism 74 and 76 allows when the control of stock 16 is transferred to the stationary clamp 12, the maximum advanced stroke limit position of the traveling slide and the stock is precisely and positively assured.

This disclosed construction effectively neuturalizes any lost motion in the crank and link mechanism, for any play in the bearings during reversal and any dwell of the crank linkage is taken up by the associated single acting drive cylinder which continuously urges its slide forwardly as far as the lost motion of he crank mechanism will permit. Accordingly, any play in the bearings and the associated crank linkage is intentionally eliminated and is not a factor in determining the terminal advanced stroke limit postion of the slides and the stock.

Moreover, the described feeder 14 is also suited to feed stock to non-piloted dies as well as piloted dies as described above. To exclusively operate with unpiloted dies, the stationary clamp 12 may be eliminated, and the operational sequence at the end of the free stroke of each slide 30, 32 would be to pressurize the opposite, previously deactivated slide drive cylinder and the clamps of its associated slide and then exhaust the clamps of the recently arrested slide in its forward stroke limit position and its associated cylinder leaving feeder 14 ready for the next feed cycle.

Based on the above description, it will be understood that the described feeder provides twin side by side slides which operate in reverse orientation to one another during a production operation utilizing the features of this invention. To effect high speed press feeds, it has been known to use mechanical control circuits which operate successfully but are highly expensive. Prior efforts to reduce expense through the use of fluid or pneumatic press feeders have met with varying success, but uniformly less than laudatory results. Pneumatic press feeders known to date simply have not achieved desired high stock feed rates for given production runs with the controlled sudden deceleration required. These results have been achieved, however, with the considerably more expensive mechanically controlled feeders. However, in accordance with the above described features of this invention, the stock feeding rates achieved are significantly higher than those heretofore known to have been successfully achieved with full stock control by conventional pneumatic feeding devices. The feeder depicted in FIGS. 1–4 has been designed to effect a maximum 4 inch stock feed length per stroke and 300 or more strokes per minute with piloted dies (and significantly higher feed rates with unpiloted dies) and also controlled stock deceleration to zero at a precisely determined advanced limit position while also using a pneumatic control system.

A pneumatic control circuit which has been found to operate successfully with feeder 14 of this invention is shown in FIGS. 5–8 wherein heavy lines are used for clarity in identifying pressurized fluid lines which are operative for the depicted sequences of the functional modes of the interconnected feeder components and their circuit elements.

Figure 5:
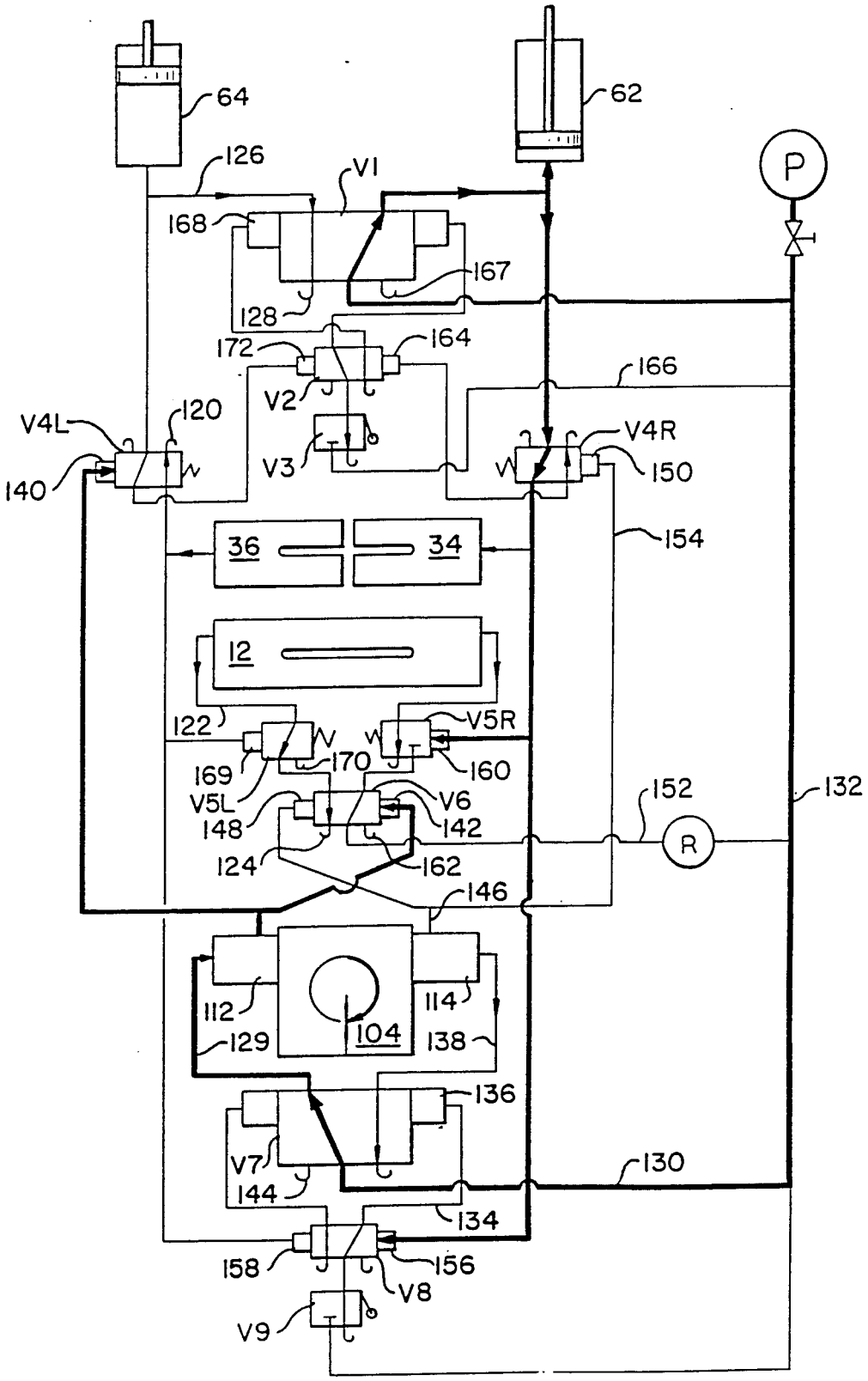
FIGS. 5–8 are schematic illustrations of the feeder components and their respective fluid circuit control elements and their functions during a feeding cycle of the feeder of FIG. 1.
Figure 6:
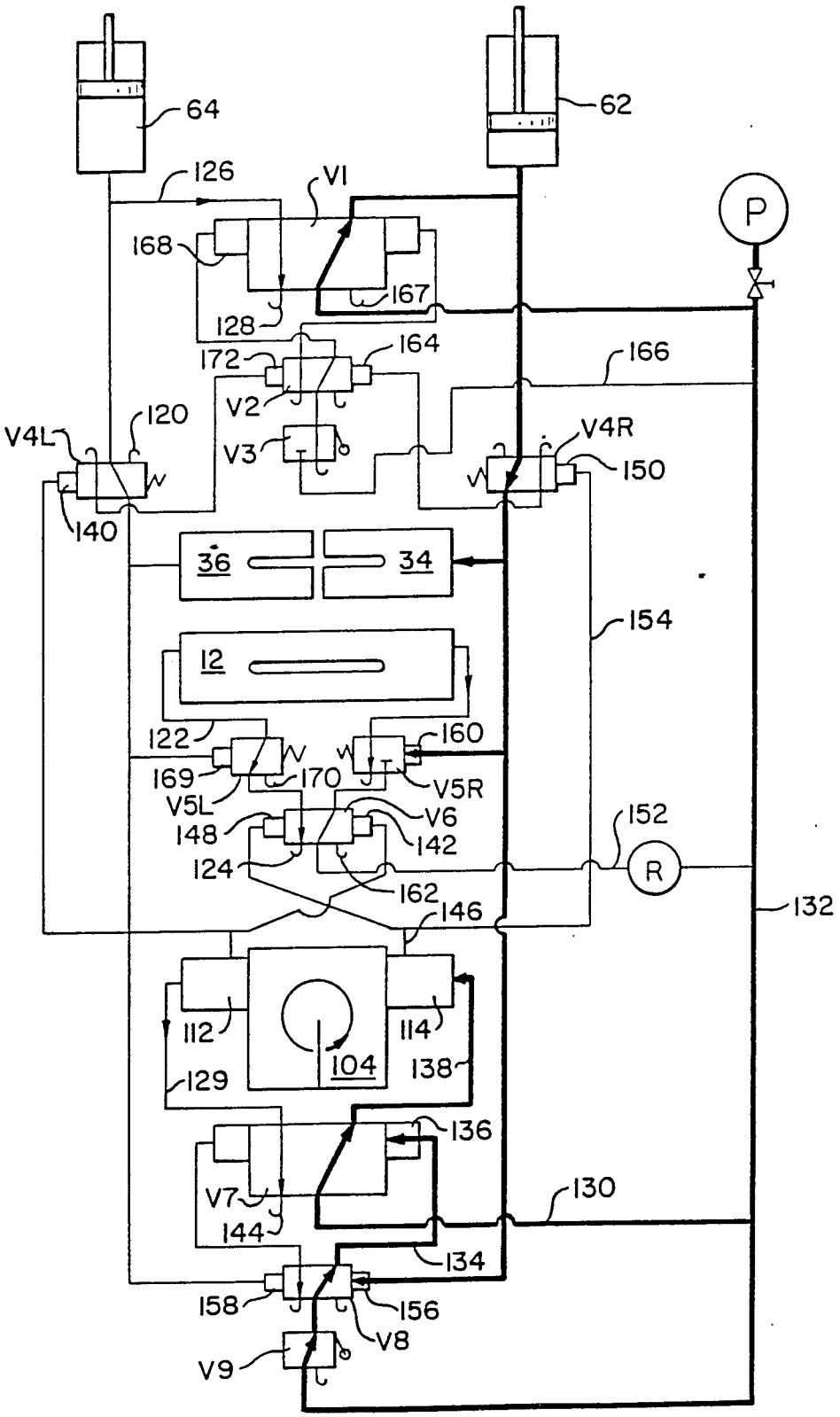

More specifically, and with reference to FIG. 5, it is to be understood that the conditions shown are just before a forward stroke of feeder 14, as described above, of the right hand feed slide 30. Air is exhausted from the left hand slide clamps 36 through exhaust port 120 of a 4 way single air pilot, spring return, slide clamp control valve V4L. Air is also exhausted from stationary clamp 12 through line 122 leading to its stationary clamp control valve V5L which is normally open to exhaust port 124 of stationary clamp power valve V6, which is a 4 way double air pilot valve. The left hand slide drive cylinder 64 is fully extended and air is exhausted therefrom through line 126 leading to exhaust port 128 of a cylinder power valve V1 which is also a double air pilot valve. As illustrated, air is "on" to the right hand slide clamps 34 and right hand drive cylinder 62 from air source "P" via cylinder power valve V1 and its slide clamp control valve V4R which is a 4 way single air pilot, spring return, valve. The power drive actuator 104 is shown conditioned to be biased in a clockwise direction under air pressure to actuator cylinder 112 through line 129 and actuator power valve V7 which is a 4 way double air pilot valve connected to source "P" by fluid lines 130, 132.

As the downstream machine such as a press and the like starts upstroke (FIG. 6), a cam operated feeder cycling valve V9, which is normally closed to air source "P", is actuated by a cam, not shown, connected to the machine crankshaft and admits air to an actuator control valve V8 which directs air through line 134 to a right hand pilot 136 of an actuator power valve V7. Valve V7 shifts to supply air to line 138 and actuator drive cylinder 114 to rotate the actuator 104 (FIG. 6) counterclockwise to start the actuator stroke. Actuator drive cylinder 112, pilot 140 of left hand slide clamp control valve V4L and right hand pilot 142 of stationary clamp power valve V6 are deactivated with air from cylinder 112 exhausting via line 129 to atmosphere through exhaust port 144 of valve V7.

Figure 7:
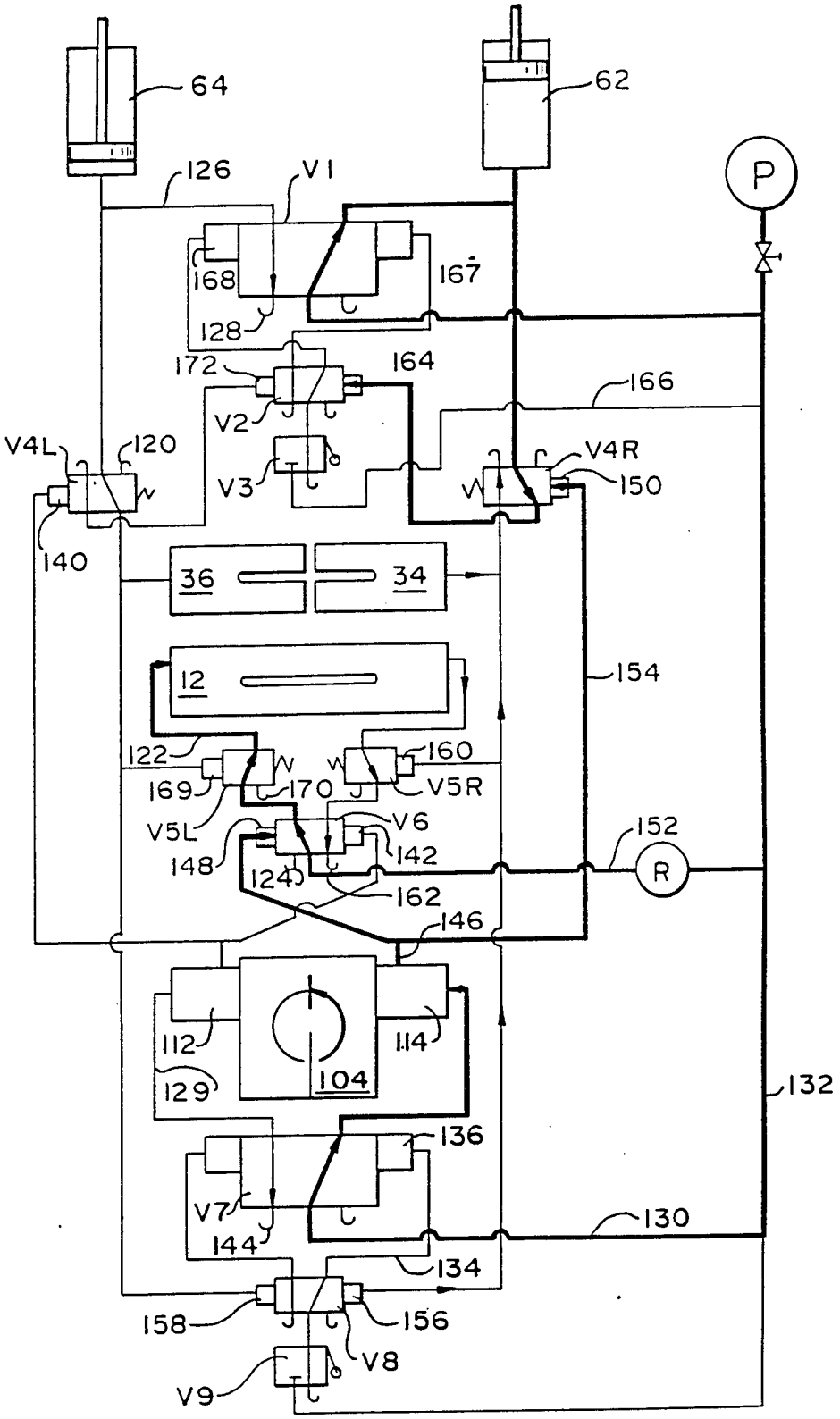

In FIG. 7, actuator 104 has completed its counterclockwise rotation through 180°. Right hand feed slide 30 has now completed its forward feed stroke travel whereupon the right hand drive cylinder 114 of actuator 104 leaks a predetermined limited volume of air through a pilot line 146 connecting actuator drive cylinder 114 to left hand pilot 148 of stationary clamp power valve V6 (a 4 way double air pilot valve) and also to pilot 150 of slide clamp control valve V4R. The stationary clamp power valve V6 now directs air from line 152 at an adjustable pressure as determined by pressure regulator "R" from air source "P" to stationary clamp control valve V5L, held open by its spring, to one of the operating pistons in stationary clamp 12. Air to pilot 150 of slide clamp control valve V4R shifts that valve against its spring return and exhausts air from the right hand slide clamp 34 after a predetermined time delay upon clamping of the stationary clamp 12 since pressure in line 154 must increase to a higher level to shift the spring return of slide clamp control valve V4R than it does to shift double pilot valve V6.

As right slide clamp control valve V4R exhausts clamp 34, it also exhausts air to right hand pilot 156 of actuator control valve V8, a double air pilot valve which is now preset and free to shift upon air later being applied to its opposite left hand pilot 158.

Shifting of slide clamp control valve V4R also effects air exhaust from pilot 160 of stationary clamp control valve V5R (FIG. 7), whereby its return spring shifts the valve V5R into its normally open position to exhaust port 162 of stationary clamp power valve V6.

Accordingly, slide clamp control valve V4R now directs air to right hand pilot 164 of cylinder control valve V2 to condition that valve for the next signal from a 3 way, cam operated cylinder reversing valve V3 which is normally closed to the air source "P", so that the next time the cylinder control valve V2 receives a signal from cylinder reversing valve V3, cylinder power valve V1 will be reversed and, consequently, the air connections will be reversed to slide drive cylinders 62 and 64.

Under these conditions (FIG. 7), right hand feed slide 30 is in its forwardmost advanced stroke limit position and left hand slide 32 is in its rearmost stroke limit position, and the stock 16 is being held by stationary clamp 12 so that pilots (not shown) in the descending dies of the downstream power press can precisely adjust the stock location in the die as described above.

The following sequence of operations occur at bottom dead center of each machine stroke (FIG. 8) when the die pilots have fully entered into the stock pilot holes to correct its location.

At bottom dead center of the machine stroke, the 3 way cam operated cylinder reversing valve V3 opens (FIG. 8) to supply air from line 166 to cylinder control valve V2 which directs it to a left hand pilot 168 of cylinder power valve V1. The latter then shifts, pressurizing left hand slide drive cylinder 64 which, however, cannot move since the left hand feed slide 32 is restrained by its associated crank mechanism 76. Shifting of cylinder power valve V1 simultaneously exhausts right hand slide drive cylinder 62 through exhaust port 167 of cylinder power valve V1.

Air also then flows through slide clamp control valve V4L, pressurizing the left hand slide clamps 36 and also pilot 169 of the stationary clamp control valve V5L which closes, exhausting air from stationary clamp 12 through line 122 and exhaust port 170 of valve V5L to release stationary clamp 12. Air also flows to left hand pilot 158 of actuator control valve V8 thereby activating that valve to a preset condition so that the next signal received from feeder cycling valve V9 will reverse actuator power valve V7 and consequently the rotational direction of power actuator 104.

As right hand slide drive cylinder 62 exhausts through exhaust port 167 of valve V1 so also is the air to slide clamp control valve V4R. This action simultaneously exhausts air from right hand pilot 164 of cylinder control valve V2 which produces no immediate effect but will permit cylinder control valve V2 to later shift upon application of air pressure to its opposite pilot 172.

Figure 8:
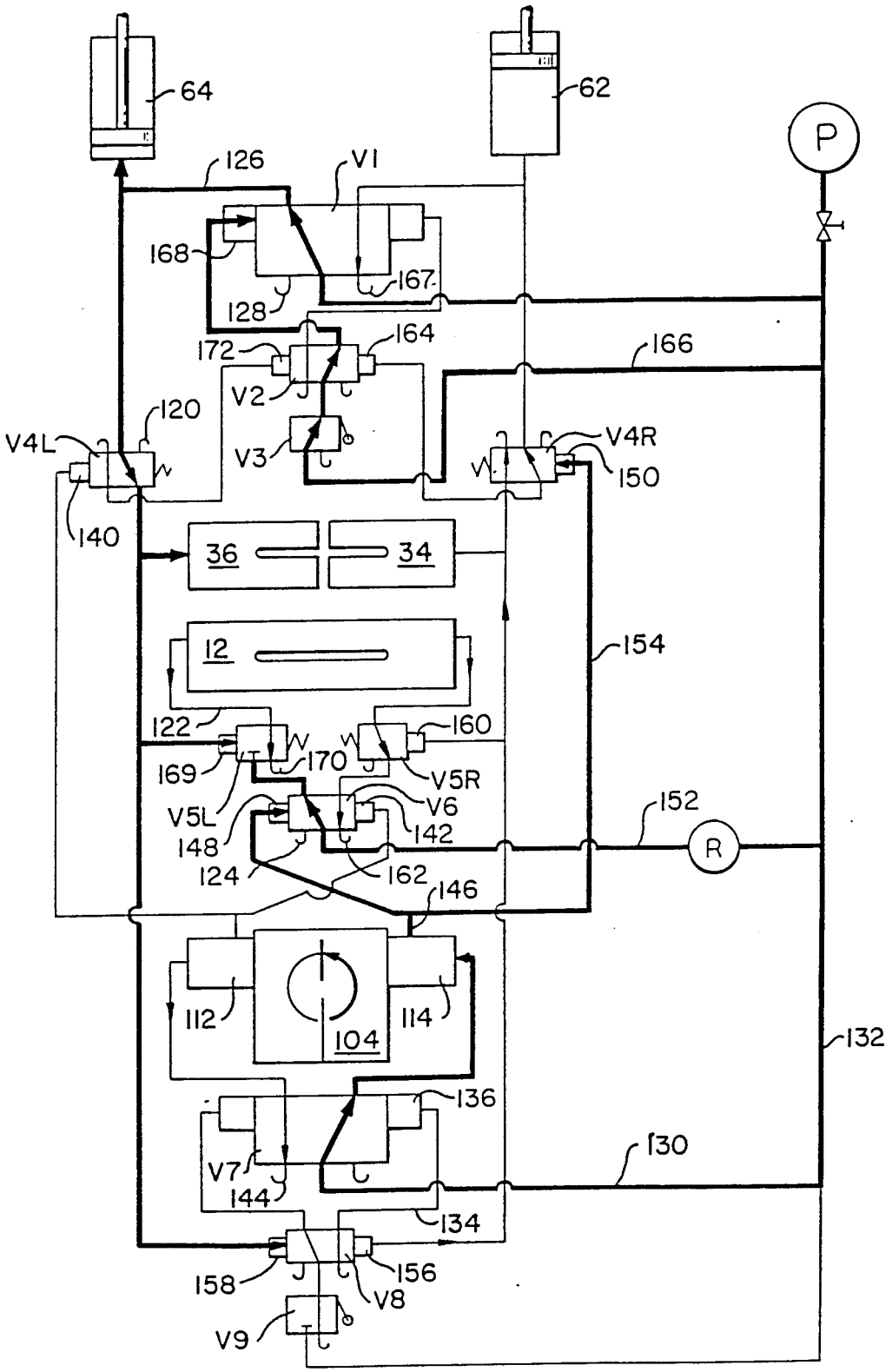
Figure 9:
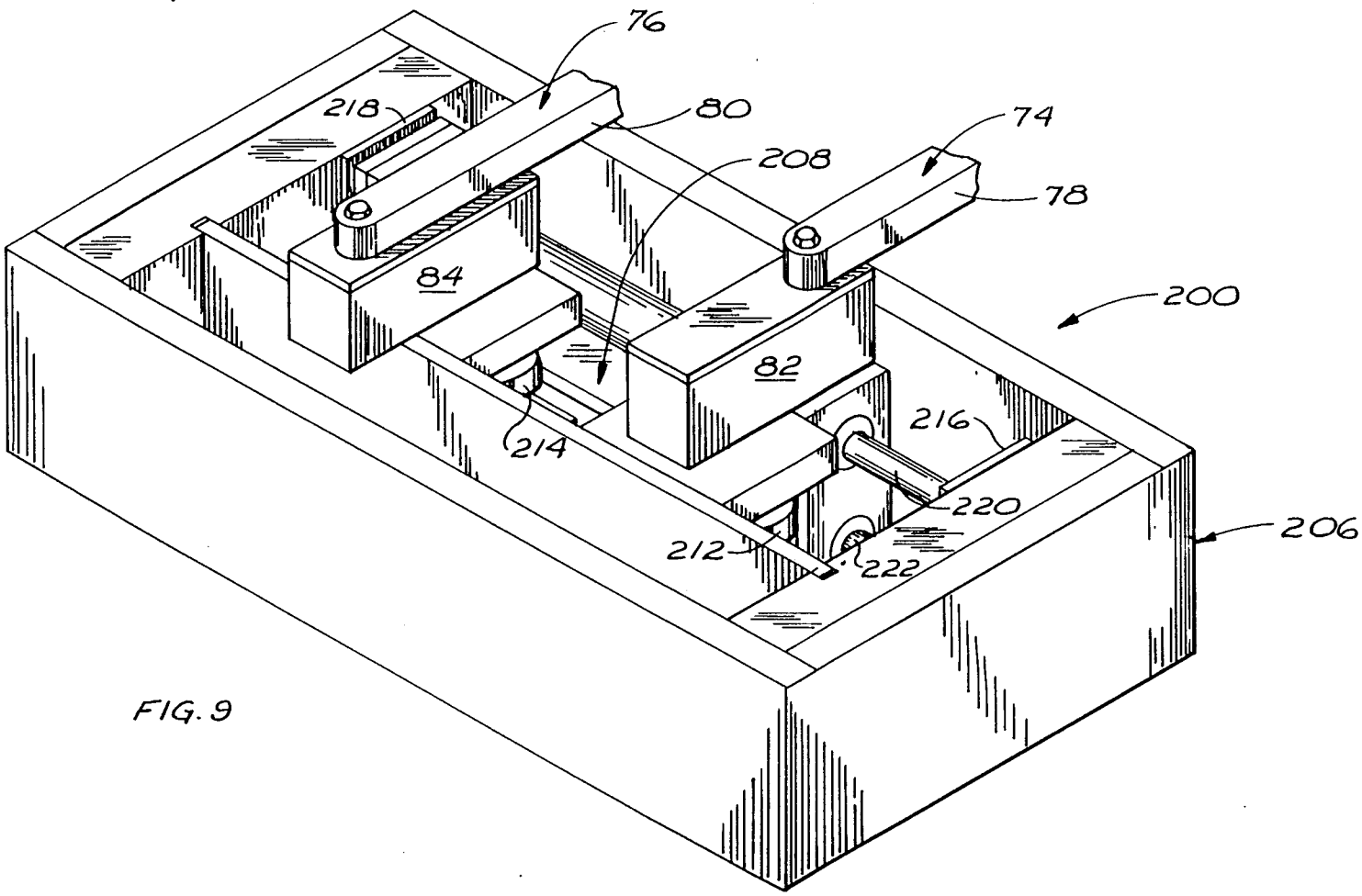
FIG. 9 is an isometric view, partly broken away, showing another embodiment of a feeder drive of this invention.
Figure 14:
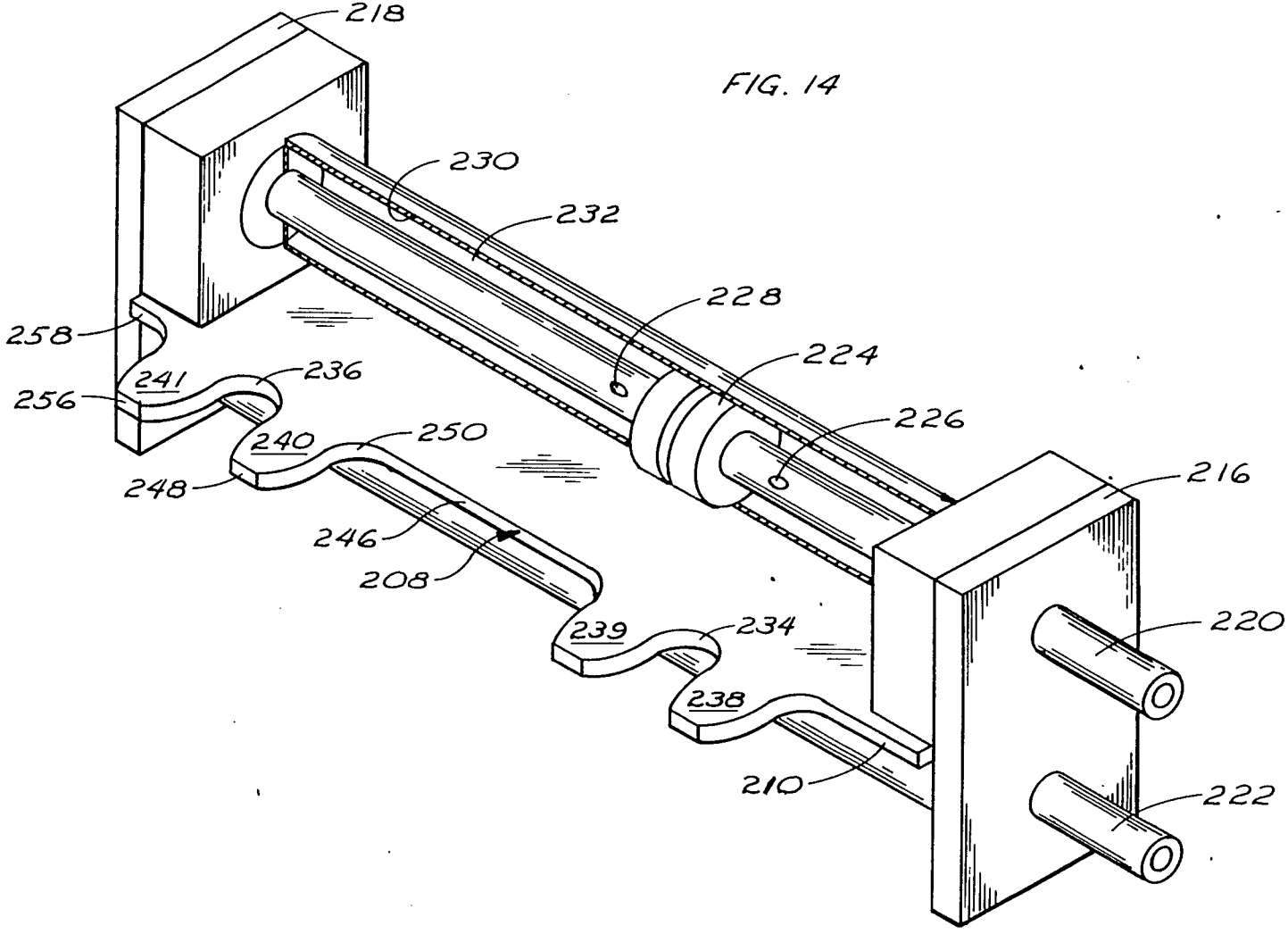
FIG. 14 is an isometric view, partly broken away and partly in section, of selected components incorporated in the feeder drive of FIG. 9.

The conditions illustrated in FIG. 8 now are the same as at the beginning of the feed stroke cycle illustrated in FIG. 5 except that what previously applied as described in FIG. 5 to the right hand side of feeder 14 now applies in FIG. 8 to the left hand side of feeder 14. Those valves which were preset in FIG. 5 for a feed stroke of right hand slide 30 are now preset for a feed stroke of left hand slide 32.

Turning now to FIGS. 9–19, another embodiment of a feeder of this invention is illustrated which, as in the first described embodiment, the feed is crank controlled such that the cranks serve first as a trigger mechanism to initiate the stroke and then as a positive stop to precisely limit feed slide travel. This second embodiment features a unique double-rotor indexing mechanism 200. This particular indexing mechanism 200 does not require rotating members such as the crank mechanisms 74, 76 to be decelerated at the same rate as linearly moving parts such as the power cylinders. Rather, in the indexing mechanism 200 of this emodiment, relative speeds of driving and driven parts need not be uniform.

Relatively constant motion of the driving member of this indexing mechanism 200 results in accelerating a driven member from zero to maximum velocity, which velocity is maintained for a period followed by a deceleration to zero velocity as indexing of the driven member is completed. Such construction results in a smooth, shock-free start and stop action effected by the indexing mechanism 200 with minimized undesired inertial effects.

As in the first described embodiment, it will be understood that the feeder of this embodiment has twin left and right hand side components of substantially identical construction in mirror image relation to one another. While certain parts have beem removed for clarity of illustration in FIGS. 9–19, it will be understood that the two drive cylinders 62, 64 and piston rods 70, 72 (FIG. 1) are suitably interconnected to two slides 30, 32 (FIG. 1) which are also drivingly connected via crank mechnisms, 74, 76 (FIGS. 1 and 9) to operating shafts 97, 99 (FIGS. 1 and 13) for crank heads 82, 84. Indexing mechanism 200 specifically serves to rotate crank heads 82, 84 and replaces the previously described rotary actuator 104 of the first embodiment.

More specifically, crank heads 82, 84 are fixedly mounted on shafts 97, 99 which are supported for rotation in bearings 202, 204 mounted on frame 206. As in the previously illustrated embodiment, crank heads 82, 84 are connected by cranks (such as those shown at 78, 80 in FIGS. 1 and 9) to slides 30, 32. In use, the feeder of this embodiment operates just as previously described in the first embodiment except for actuation of crank heads 82, 84 by the improved indexing mechanism. As in the first embodiment, the two crank heads 82, 84 are moved simultaneously by mechanism 200 and in the same angular direction to effect alternating straightline feed in the illustrated double-head feeder.

In the specifically illustrated embodiment, a cam assembly 208 is shown having a single linear driver or cam 210 for a pair of driven rotors 212, 214 fixed to crank head shafts 97, 99. The linear cam 210 is fixed between a pair of end blocks 216, 218 supported for reciprocating sliding movement in a straight line path by fixed hollow guide rods 220, 222 secured to opposite sides of frame 206. Suitable fluid line connections, not shown, are connected to opposite ends of one or both of the hollow guide rods such as at 220 which has a fixed piston 224 (FIG. 14) intermediate its ends and ports 226, 228 adjacent opposite ends of piston 224. Piston 224 is received within a cylinder 230 fixed between end blocks 216, 218 in concentric relation to guide rod 220. To reciprocate cam assembly 208, pressurized air is admitted to cylinder 230 on an end of piston 224 corresponding to the desired direction of movement of cam assembly 208, and the fluid line (not shown) to cylinder 230 on the opposite end of cylinder 230 will be understood to be open to exhaust.

Suitable pneumatic controls, not shown, also will be understood to be provided to selectively establish and reverse air connections to cylinder 230 responsive to a signal from the downstream machine, not shown. As in the previously described embodiment, when the downstream machine starts an upstroke movement, a cam, not shown, drivingly connected to a crank shaft of the machine, for example, may be provided to operate a valve, not shown, to signal indexing mechanism 200, and thereby exhausting air from the chamber 232 (FIG. 12) of cylinder 230 on the left side of piston 224, as viewed in the drawings, and pressurizing cylinder chamber 232 on the right side of piston 224 to drive linear cam 210 from its illustrated position in FIG. 10 to the right (as viewed in the drawings) to its position shown in FIG. 11.

Such action initiates movement of left hand crank mechanism 76 (connected to left hand feed slide 32) to be driven off dead center and triggers a movement of the previously pressurized drive cylinder 64 to move crank head 84 and slide 32 forwardly from its starting position to an advanced stroke limit position by drive cylinder 64 and piston rod 72 in cooperation with a clockwise throw of its associated crank mechanism 76. Simultaneously, right hand crank mechanism 74 rotates in the same clockwise direction of rotation as crank mechanism 76 from an advanced stroke limit position into a retracted starting stroke limit position. As in the first embodiment, during idle return of right hand slide 30 under a clamp release condition during the stock advancing movement by left hand slide 32 with its clamps 32 activated, the throw of crank mechanism 74 effects a corresponding return of piston within drive cylinder 62 to starting position, exhausting air from cylinder 62 (FIG. 1). At the end of each feed stroke, a signal is generated, as fully described above, to effect sequential events in timed relation to downstream machine cycling.

To achieve such operation in a simplified indexing mechanism 200 featuring the above described advantages, cam 210 is preferably formed of flat hardened steel with a profiled cam surface on one longitudinally extending edge. A pair of slots 234, 236 are shown (best seen in FIG. 14) formed adjacent opposite longitudinal ends of cam 210 with each slot 234, 236 being defined respectively by a pair of spaced teeth 238, 239 and 240, 241.

Figure 15:
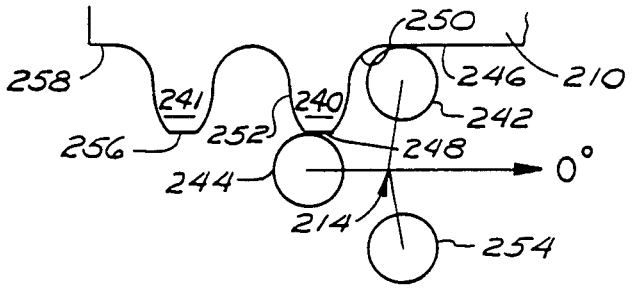
FIGS. 15–19 are schematic illustrations showing relative positions of a feeder drive of FIG. 14 and cooperating rotor during a feeding cycle of the feeder drive of FIG. 9.
Figure 19:
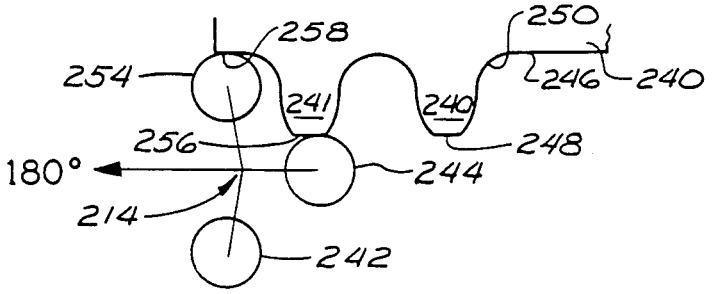

Upon activating air cylinder 230 to drive cam assembly 208 from left to right as viewed in FIGS. 10 and 11, the starting rotor position is illustrated in FIGS. 10 and 15 preliminary to the rotors, such as at 214, being driven into an opposite angular position displaced 180° as seen in FIGS. 11 and 19, whereby the right and left hand crank heads 82, 84 are respectively driven in the same angular clockwise direction in unison between opposite crank throw limit positions.

The construction and movement of rotors 212, 214 are identical, and it will suffice for an understanding of this invention to describe the movement of rotor 214 and its crank head 84, while recognizing that a single cam movement effects the same driving action on rotor 212 and its crank head 82 except that the latter is positioned in a crank throw limit position opposite that of crank head 84.

Figure 16:
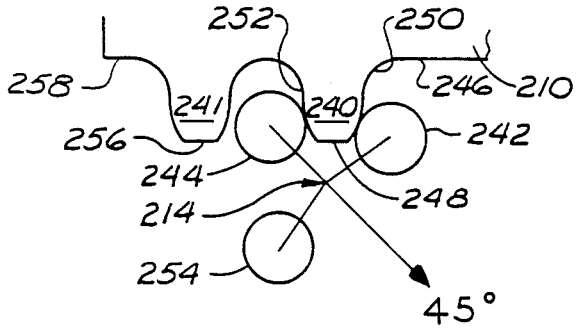
Figure 17:
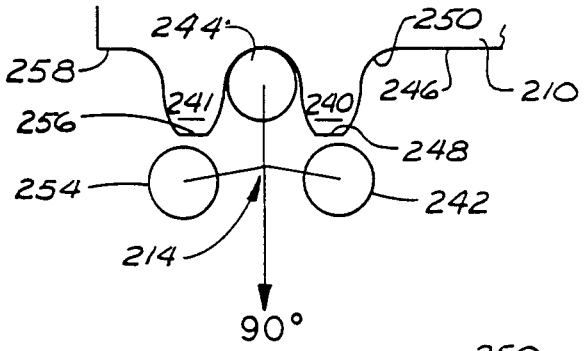
Figure 18:
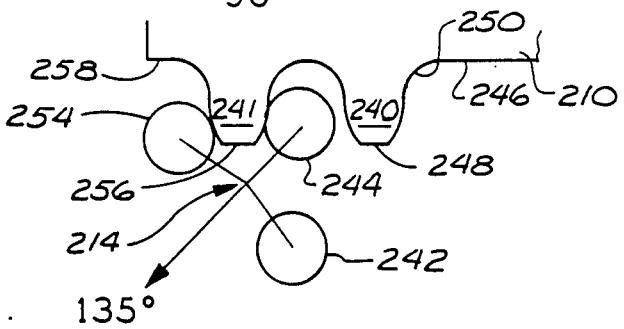

Referring now specifically to FIGS. 10 and 15, initial movement of linear cam 210 does not produce immediate rotation of rotor 214 as its rollers 242 and 244 are respectively resting on cam flats at 246 and 248. Continued movement of linear cam 210 causes fillet 250 to engage roller 242 and rotate rotor 214 as roller 244 remains in contact with flank 252 of tooth (FIG. 16). Accordingly, lost motion between linear cam 210 and rotor 214 is minimized. As linear cam 210 progresses from its position in FIGS. 10 and 15 to its position in FIG. 16, rotor 214 accelerates to its maximum velocity. From FIGS. 16 to 18, rotor 214 generally maintains a constant velocity and from FIG. 18 to FIG. 19, rotor 214 is decelerated to zero velocity and dwells during the final movement of linear cam 210. During such final cam movement, rollers 244 and 254 are respectively engaged on flats 256 (of tooth 241) and 258 (of cam 210), thereby positively limiting angular displacement of rotor 214 precisely to 180°.

From the above description and drawings, it will be understood that both rotors 212, 214 move in synchronism in the same angular direction to correspondingly rotate crank heads 82, 84 and associated linkage to feed slides 30, 32 in a common angular direction to provide an improved double-head straight-line feed with insignificant lost motion between the linear cam driver 210 and rotors 212, 214. It will be noted that the linear cam driver 210 may overtravel slightly and is brought to a halt by both air and mechanical buffering which has much less tendency to lengthen the cycle time since it takes place primarily after the feed stroke is complete and in the interval in which the downstream machine requires the material to be stationary during linear cam overtravel.

Upon reversing the air connections to the self-contained power cylinders such as at 230 responsive to a signal from downstream machine cycling, rotors 212, 214 are rotated in the opposite angular direction in unison to move from the position illustrated in FIGS. 11 and 19 to the position illustrated in FIGS. 10 and 15 in reverse sequence to that described above, simultaneously moving both crank heads 82, 84 in a selected angular direction for synchronized alternating feed slide action.

As will be apparent to persons skilled in the art, various modifications, adaptations and variations of the foregoing specific disclosure can be made without departing from the teachings of this invention.

I claim:

1. A feeder for advancing stock in intermittent feed strokes into a downstream work station of a machine such as a power press and the like and comprising a frame, a power operated feed slide mounted on the frame for reciprocating linear movement between starting and advanced stroke limit positions, the feed slide having a releasable stock clamp operable for clamping stock and thereafter advancing the clamped stock during a feed stroke in unison with movement of its feed slide from starting to advanced positions, a rotary crank mechanism mounted on the frame and drivingly connected to the feed slide, the crank mechanism being movable through a predetermined displacement in opposite angular directions precisely defining first and second crank throw limit positions terminating movement of the feed slide in opposite linear directions in said starting and advanced stroke limit positions, and a fluid operated, single acting power cylinder cooperating with the crank mechanism for driving the feed slide from its starting position to advanced stroke limit position, the power cylinder being deactivated during an idle return movement of the feed slide from advanced stroke limit position to its starting position under the driving force of its crank mechanism.

2. The feeder of claim 1 wherein the crank mechanism is adjustable to selectively establish the advanced stroke limit position of the feed slide relative to the frame.

3. The feeder of claim 1 or claim 2 wherein the crank mechanism serves as a slide actuator upon crank mechanism movement in one angular direction to release the feed slide from starting position to be driven by its power cylinder in a stock advancing direction, the power cylinder cooperating with the crank mechanism to drive the feed slide precisely into its advanced stroke limit position as defined by the throw of the crank mechanism in said one angular direction.

4. The feeder of claim 3 wherein return of the crank mechanism in the opposite angular direction serves to retract both the feed slide and its power cylinder to starting position.

5. The feeder of claim 3 further including an actuator movably supported on the frame and connected to the crank mechanism for driving it in selected angular directions.

6. The feeder of claim 3 wherein the driving connection between the crank mechanism and its feed slide serves to effect a harmonic deceleration of the feed slide into its stroke limit position as the crank mechanism approaches the limits of its angular displacement.

7. The feeder of claim 3 wherein the power cylinder serves to take up lost motion of the crank mechanism in a stock advancing direction with the crank mechanism in its second crank throw position.

8. A feeder for advancing stock in intermittent feed strokes into a downstream work station of a machine such as a power press and the like and comprising a frame, a pair of power operated, alternately acting, feed slides mounted in side-by-side parallel relation on the frame for reciprocating linear movement between starting and advanced stroke limit positions, each feed slide having a releasable stock clamp operable for clamping stock and thereafter advancing the clamped stock during a feed stroke in unison with movement of the feed slide from starting to advanced positions, a pair of rotary crank mechanisms mounted on the frame and drivingly connected to the feed slides, the crank mechanisms each being movable through a predetermined displacement in opposite angular directions precisely defining first and second crank throw limit positions terminating movement of its respective feed slide in opposite linear directions in said starting and advanced stroke limit positions, a drive connected to both of the crank mechanisms for simultaneously moving them in a selected angular direction for synchronized alternating feed slide action, and a fluid operated power cylinder drivingly connected to each feed slide, the crank mechanism of each feed slide serving as a slide actuator upon crank mechanism movement in one augular direction to release the feed slide from starting position to be driven by its power cylinder in a stock advancing direction, each power cylinder cooperating with the crank mechanism of its respective feed slide to drive the same precisely into its advanced stroke limit position as defined by the throw of the crank mechanism in said one angular direction.

9. The feeder of claim 8 wherein each crank mechanism is adjustable to selectively establish the advanced stroke limit position of its respective feed slide relative to the frame.

10. The feeder of claim 8 wherein return of the crank mechanism for each feed slide in the opposite angular direction serves to retract both the feed slide and its power cylinder to starting position.

11. The feeder of claim 8 wherein the driving connection between each crank mechanism and its feed slide serves to effect a harmonic deceleration of the feed slide into its stroke limit positions as the crank mechanism approaches the limits of its angular displacement.

12. The feeder of claim 8 wherein the releasable stock clamp of each feed slide comprises a pair of power operated clamping members for positively fixing the stock relative to the slide and ensuring that forward movement of the stock during each feed stroke is precisely stopped upon termination if its feed slide movement in its advanced stroke limit position upon its respective crank mechanism reaching its second crank throw position.

13. The feeder of claim 8 wherein each crank mechanism is movable through 180° in one angular direction from its first to second crank throw limit positions in unison with a corresponding 180° angular displacement of the other crank mechanism in said one angular direction from its second to first crank throw limit positions.

14. The feeder of claim 8 further including fluid circuit means connected between the rotary drive and the clamps of the feed slides for operating each clamp to lock the stock in its respective feed slide during a feed stroke from starting to advanced positions and releasing each clamp during an idle return stroke from advanced to starting positions in timed relation to crank mechanism movements.

15. The feeder of claim 8 wherein each crank mechanism includes a crank head supported on the frame for rotation about an axis perpendicular to the axis of reciprocating movement of its respective feed slide, wherein the drive includes a rotary drive actuator supported on the frame for rotation in opposite angular directions and drivingly connected to the crank heads for simultaneously driving them in selected angular directions, and wherein a crank link is pivotally connected between each crank head and its respective feed slide for controlling its movement between starting and advanced feed stroke limit positions.

16. The feeder of claim 15 wherein the axis of rotation of each crank head intersects the axis of reciprocating movement of its respective feed slide, and wherein the pivot connection between each crank head and crank link is eccentrically offset from the crank head axis of rotation.

17. The feeder of claim 16 wherein the crank head and crank link of each crank mechanism are aligned with one another and with the axis of reciprocating movement of its respective feed slide in said first and second crank throw limit positions.

18. The feeder of claim 15 or claim 17 wherein rotation of the rotary actuator in one angular direction effects simultaneous rotation of the feed heads in a common angular direction through a 180° angular displacement for moving the crank mechanisms in unison into first and second crank throw limit positions, respectively, for precisely locating the first and second feed slides in their starting and advanced stroke limit positions, respectively.

19. The feeder of claim 8 wherein the power cylinders each serve to take up lost motion of their respective crank mechanism in a stock advancing direction with the crank mechanism in its second crank throw position.

20. A feeder for advancing stock in intermittent feed strokes into a downstream work station of a machine such as a power press and the like and comprising a frame, a power operated feed slide mounted on the frame for reciprocating linear movement between starting and advanced stroke limit positions, the feed slide having a releasable stock clamp operable for clamping stock and thereafter advancing the clamped stock during a feed stroke in unison with movement of its feed slide from starting to advanced positions, a rotary crank mechanism mounted on the frame and drivingly connected to the feed slide, the crank mechanism being movable through a predetermined displacement in opposite angular directions precisely defining first and second crank throw limit positions terminating movement of the feed slide in opposite linear directions in said starting and advanced stroke limit positions, and a fluid operated power cylinder drivingly connected to the feed slide, the crank mechanism serving as a slide actuator upon crank mechanism movement in one angular direction to release the feed slide from starting position to be driven by its power cylinder in a stock advancing direction, the power cylinder cooperating with the crank mechanism to drive the feed slide precisely into its advanced stroke limit position as defined by the throw of the crank mechanism in said one angular direction, the power cylinder serving to take up lost motion of the crank mechanism in a stock advancing direction with the crank mechanism in its second crank throw position, the power cylinder being single acting for driving the feed slide from its starting position to advanced stroke limit position, the power cylinder being deactivated during an idle return movement of the feed slide from advanced stroke limit position to its starting position under the driving force of its crank mechanism.

21. The feeder of claim 20 wherein the crank mechanism is adjustable to selectively establish the advanced stroke limit position of the feed slide relative to the frame.

22. A feeder for advancing stock in intermittent feed strokes into a downstream work station of a machine such a power press and the like and comprising a frame, a pair of power operated, alternately acting, feed slides mounted in side-by-side parallel relation on the frame for reciprocating linear movement between starting and advanced stroke limit positions, a fluid operated power cylinder drivingly connected to each feed slide, each feed slide having a releasable stock clamp operable for clamping stock and thereafter advancing the clamped stock during a feed stroke in unison with movement of its feed slide from starting to advanced positions, and a pair of rotary crank mechanisms mounted on the frame and drivingly connected to the feed slides, the crank mechanisms each being movable through a predetermined displacement in opposite angular directions precisely defining first and second crank throw limit positions terminating movement of its respective feed slide in opposite linear directions in said starting and advanced stroke limit positions, the crank mechanism of each feed slide serving as a slide actuator upon crank mechanism movement in one angular direction to release the feed slide from starting position to be driven by its power cylinder in a stock advancing direction, each power cylinder cooperating with the crank mechanism of its respective feed slide to drive the same precisely into its advanced stroke limit position as defined by the throw of the crank mechanism in said one angular direction, the power cylinders each serving to take up lost motion of their respective crank mechanism in a stock advancing direction with the crank mechanism in its second crank throw position, the power cylinders each being single acting for driving its respective feed slide from its starting position to advanced stroke limit position, the power cylinders each being deactivated during an idle return movement of its feed slide from advanced stroke limit position to its starting position under the driving force of its crank mechanism.

23. The feeder of claim 22 wherein each crank mechanism is adjustable to selectively establish the advanced stroke limit position of its respective feed slide relative to the frame.

24. A feeder for advancing stock in intermittent feed strokes into a downstream work station of a machine such as a power press and the like and comprising a frame, a pair of power operated, alternately acting, feed slides mounted in side-by-side parallel relation on the frame for reciprocating linear movement between starting and advanced stroke limit positions, a fluid operated power cylinder drivingly connected to each feed slide, each feed slide having a releasable stock clamp operable for clamping stock and thereafter advancing the clamped stock during a feed stroke in unison with movement of its feed slide from starting to advanced positions, a pair of rotary crank mechanisms mounted on the frame and drivingly connected to the feed slides, the crank mechanisms each being movable through a predetermined displacement in opposite angular directions precisely defining first and second crank throw limit positions terminating movement of its respective feed slide in opposite linear directions in said starting and advanced stroke limit positions, the crank mechanism of each feed slide serving as a slide actuator upon crank mechanism movement in one angular direction to release the feed slide from starting position to be driven by its power cylinder in a stock advancing direction, each power cylinder cooperating with the crank mechanism of its respective feed slide to drive the same precisely into its advanced stroke limit position as defined by the throw of the crank mechanism in said one angular direction, and an actuator supported on the frame and connected to both of the crank mechanisms for simultaneously driving them in selected angular directions, the actuator including a power operator for driving the actuator in succession in opposite directions for simultaneously operating the feed slides in alternately advancing and retracting feed slide movements.

25. The feeder of claim 24 wherein each crank mechanism is adjustable to selectively establish the advanced stroke limit position of its respective feed slide relative to the frame.

26. A feeder for advancing stock in intermittent feed strokes into a downstream work station of a machine such as a power press and the like and comprising a frame, a pair of power operated, alternately acting, feed slides mounted in side-by-side parallel relation on the frame for reciprocating linear movement between starting and advanced stroke limit positions, each feed slide having a releasable stock clamp operable for clamping stock and thereafter advancing the clamped stock during a feed stroke in unison with movement of its feed slide from starting to advanced positions, a pair of rotary crank mechanisms mounted on the frame and drivingly connected to the feed slides, the crank mechanisms each being movable through a predetermined displacement in opposite angular directions precisely defining first and second crank throw limit positions terminating movement of its respective feed slide in opposite linear directions in said starting and advanced stroke limit positions, each crank mechanism including a crank head supported on the frame for rotation about an axis perpendicular to the axis of reciprocating movement of its respective feed slide, an actuator being supported for movement on the frame and drivingly connected to the crank heads for simultaneously driving them in selected angular directions, a crank link being pivotally connected between each crank head and its respective feed slide for controlling its movement between starting and advanced feed stroke limit positions, movement of the actuator in one direction effecting simultaneous rotation of the feed heads in a common angular direction through a 180° angular displacement for moving the crank mechanisms in unison into first and second crank throw limit positions, respectively, for precisely locating the first and second feed slides in their starting and advanced stroke limit positions, respectively, and a single acting power cylinder drivingly connected to each feed slide for power operating the same in a stock advancing direction from its starting position to advanced stroke limit position, the power cylinders each serving to take up lost motion of their respective crank mechanisms in a stock advancing direction, the power cylinders each being deactivated during an idle return movement of its feed slide from advanced stroke limit position to its starting position under the driving force of its crank mechanism.

27. The feeder of claim 26 wherein the axis of rotation of each crank head intersects the axis of reciprocating movement of its respective feed slide, and wherein the pivot connection between each crank head and crank link is eccentrically offset from the crank head axis of rotation.

28. The feeder of claim 27 wherein the crank head and crank link of each crank mechanism are aligned with one another and with the axis of reciprocating movement of its respective feed slide in said first and second crank throw limit positions.

29. A feeder for advancing stock in intermittent feed strokes into a downstream work station of a machine such as a power press and the like and comprising a frame, a pair of power operated, alternately acting, feed slides mounted in side-by-side parallel relation on the frame for reciprocating linear movement between starting and advanced stroke limit positions, each feed slide having a releasable stock clamp operable for clamping stock and thereafter advancing the clamped stock during a feed stroke in unison with movement of its feed slide from starting to advanced positions, a pair of rotary crank mechanisms mounted on the frame and drivingly connected to the feed slides, the crank mechanisms each being movable through a predetermined displacement in opposite angular directions precisely defining first and second crank throw limit positions terminating movement of its respective feed slide in opposite linear directions in said starting and advanced stroke limit position, drive means connected to the crank mechanisms for simultaneously moving them in a selected angular direction for synchronized alternating feed slide action, fluid circuit means connected between the drive means and the clamps of the feed slides for operating each clamp to lock the stock in its respective feed slide during a feed stroke from starting to advanced positions and releasing each clamp during an idle return stroke from advanced to starting positions in timed relation to crank mechanism movements, a single acting reciprocable cylinder drivingly connected to each feed slide and connected to the fluid circuit means for power operating the feed slide in a stock advancing direction from its starting to advanced positions, the fluid circuit means having control means for activating the cylinder and clamp of one feed slide and deactivating the other feed slide cylinder and clamp, and a machine operated feeder cycling valve operable in timed relation to initiation of a machine upstroke for actuating the drive means and permitting feed stroke advance of said one feed slide under the driving power of its cylinder in cooperation with its crank mechanism and returning the other feed slide and its cylinder to starting position under the driving power of its crank mechanism.

30. The feeder of claim 29 wherein the fluid circuit means further includes means for maintaining the drive means in the last position to which it was moved to restrain each feed slide against movement from starting position under the influence of its power cylinder until actuation of the machine operated feed cycling valve.

31. The feeder of claim 29 or claim 30 wherein a fluid operated stationary clamp is mounted on a downstream end of the frame, and wherein the fluid circuit includes a second machine operated valve operable in timed relation to completion of a machine downstroke at bottom center for reversing the fluid connections to the feed slide cylinders and clamps and conditioning the drive means for reverse movement, the fluid circuit means being connected to the stationary clamp to control its operation and effect a stock clamping action between movements of the drive means and to release the stationary clamp during movement of the drive means.

32. The feeder of claim 31 wherein the fluid circuit means includes a fluid control for the drive means and adjustable throttling means for governing fluid discharge from the fluid control of the drive means to the stationary clamp for selectively setting its stock clamping force between movements of the drive means.

33. A feeder for advancing stock in intermittent feed strokes into a downstream work station of a machine such as a power press and the like and comprising a frame; a feed slide mounted on the frame for reciprocating linear movement between starting and advanced stroke limit positions for intermittently advancing stock to the work station; a powered operator for the feed slide including a crank mechanism mounted on the frame and drivingly connected to the feed slide, the crank mechanism being movable through a predetermined angular displacement in opposite angular directions defining first and second crank throw limit positions terminating movement of the feed slide in opposite linear directions respectively in said starting and advanced stroke limit positions; a fluid operated power cylinder drivingly connected to the feed slide and cooperating with the crank mechanism to drive the feed slide from its starting position precisely into its advanced stroke limit position as defined by the throw of the crank mechanism in one angular direction; and an indexing mechanism for controlling operation of the feed slide, the indexing mechanism including a driver mounted for linear reciprocating movement on the frame, a driven rotor supported for rotation on the frame about a fixed axis and drivingly connected to the crank mechanism for moving it in said opposite angular directions between its first and second crank throw limit positions, and a driving connection between the drive and rotor.

34. The feeder of claim 33 wherein the driver includes a profiled cam having roller engagement surfaces, and wherein the driven rotor includes a plurality of rollers engageable with said roller engagement surfaces of the cam for rotating the rotor in opposite angular directions in following response to reciprocating linear movements of the driver.

35. The feeder of claim 34 wherein the roller engagement surfaces of said profiled cam additionally include cam flats for engaging said rollers without rotating said driven rotor for a portion of said reciprocating linear movements of said driver.

36. The feeder of claim 33 wherein the driver includes a profiled cam having a pair of spaced teeth defining three discrete roller engagement surfaces, and wherein three rollers are mounted on the rotor for engagement with the three roller engagement surfaces respectively.

37. The feeder of claim 36 wherein the roller engagement surfaces include first and second surfaces on opposite sides of said pair of spaced teeth for meshing engagement with first and second rollers to define first and second index positions for the rotor precisely angularly displaced 180° from one another for establishing said first and second crank throw limit positions, and wherein a third roller engagement surface is defined between said pair of spaced teeth for meshing engagement with a third roller, the roller engagement surfaces being contoured for continuous engagement with at least one roller and minimal lost motion between the cam and rotor.

38. The feeder of claim 36 wherein said profiled cam includes flat surfaces on and adjacent to said teeth for engaging said rollers without rotating said driven rotor for a portion of said reciprocating linear movements of said driver.

39. The feeder of claim 33 wherein the power cylinder is single acting and serves to take up lost motion of the crank mechanism in a stock advancing direction, the power cylinder being deactivated during an idle return movement of the feed slide from advanced stroke limit position to its starting position under the influence of the crank mechanism drivingly connected to the indexing mechanism.

40. The feeder of claim 33 including means on said driver and driven rotor to permit linear movement of said driver without rotation of said driven rotor prior to and following a 180° rotation of said rotor.

41. A feeder for advancing stock in intermittent feed strokes into a downstream work station of a machine such as a power press and the like and comprising:

a frame;

a feed slide mounted on the frame for reciprocating linear movement between starting and advanced stroke limit positions for intermittently advancing stock to the work station;

a powered operator for the feed slide including a crank mechanism mounted on the frame and drivingly connected to the feed slide, the crank mechanism being movable through a 180° angular displacement in opposite angular directions defining first and second crank throw limit positions terminating movement of the feed slide in opposite linear directions respectively in said starting and advanced stroke limit positions; and an indexing mechanism for controlling operation of the feed slide, the indexing mechanism including a profiled cam driver mounted for linear reciprocating movement on the frame, the cam driver having roller engaging surfaces including cam flats, a driven rotor supported for rotation on the frame about a fixed axis and drivingly connected to the crank mechanism for moving it in said opposite angular directions between its first and second crank throw limit positions, the driven rotor including a plurality of rollers engageable with said roller engagement surfaces of the cam driver for rotating the rotor in opposite angular directions in following response to reciprocating linear movements of the driver, said cam flats engaging said rollers without rotating said driven rotor for a portion of said reciprocating linear movements of said driver.

42. A feeder for advancing stock in intermittent feed strokes into a downstream work station of a machine such as a power press and the like and comprising:

a frame;

a feed slide mounted on the frame for reciprocating linear movement between starting and advanced stroke limit positions for intermittently advancing stock to the work station;

a powered operator for the feed slide including a crank mechanism mounted on the frame and drivingly connected to the feed slide, the crank mechanism being movable through a 180° angular displacement in opposite angular directions defining first and second crank throw limit positions terminating movement of the feed slide in opposite linear directions respectively in said starting and advanced stroke limit positions; and an indexing mechanism for controlling operation of the feed slide, the indexing mechanism including a driver mounted for linear reciprocating movement on the frame, the driver including a profiled cam having a pair of spaced teeth defining three discrete roller engagement surfaces with flat surfaces on and adjacent to said teeth, a driven rotor supported for rotation on the frame about a fixed axis and drivingly connected to the crank mechanism for moving it in said opposite directions between its first and second crank throw limit positions, the driven rotor having three rollers for engagement with the three cam driver roller engagement surfaces, respectively, the cam driver flat surfaces engaging said rollers without rotating said driven rotor for a portion of said reciprocating linear movements of said driver.

* * * * *

UNITED STATES PATENT AND TRADEMARK OFFICE

CERTIFICATE OF CORRECTION

PATENT NO. : 4,694,982

DATED : September 22, 1987

INVENTOR(S) : Edwin W. Plumb

It is certified that error appears in the above-identified patent and that said Letters Patent is hereby corrected as shown below:

Column 4, line 2, wherein the word "ene" should be --end--.

Column 8, line 64, wherein the word "he" should be --the--.

Column 8, line 68, wherein the word "postion" should be --position--.

Column 15, line 55, wherein the word "if" should be --of--.

Signed and Sealed this

Twenty-third Day of August, 1988

*Attest:*

*Attesting Officer*

DONALD J. QUIGG

*Commissioner of Patents and Trademarks*